US012497742B2

(12) United States Patent
Wilson et al.

(10) Patent No.: US 12,497,742 B2
(45) Date of Patent: Dec. 16, 2025

(54) POST FOR A SOUND WALL AND SOUND WALL EMPLOYING THE SAME

(71) Applicant: AIL INTERNATIONAL INC., Sackville (CA)

(72) Inventors: Michael W. Wilson, Sackville (CA); Wayne W. Ford, Moncton (CA)

(73) Assignee: AIL International Inc., Sackville (CA)

( * ) Notice: Subject to any disclaimer, the term of this patent is extended or adjusted under 35 U.S.C. 154(b) by 506 days.

(21) Appl. No.: 17/425,260

(22) PCT Filed: Jan. 23, 2020

(86) PCT No.: PCT/CA2020/050077

§ 371 (c)(1),
(2) Date: Jul. 22, 2021

(87) PCT Pub. No.: WO2020/150825

PCT Pub. Date: Jul. 30, 2020

(65) Prior Publication Data

US 2022/0127805 A1 Apr. 28, 2022

Related U.S. Application Data

(60) Provisional application No. 62/795,724, filed on Jan. 23, 2019.

(51) Int. Cl.
*E01F 8/00* (2006.01)
*E04H 17/00* (2006.01)
(Continued)

(52) U.S. Cl.
CPC ..... *E01F 8/0023* (2013.01); *E04H 17/009* (2021.01); *E04H 17/20* (2013.01); *E04H 17/263* (2013.01)

(58) Field of Classification Search
CPC . E04H 12/22; E04H 12/2215; E04H 12/2253; E04H 12/2261; E04H 17/009;
(Continued)

(56) References Cited

U.S. PATENT DOCUMENTS 319,558 A * 6/1885 Carpenter ..... E04H 12/2261 52/292
435,978 A * 9/1890 Ramer, Jr. et al. ..... E04H 12/2215 52/165
(Continued)

FOREIGN PATENT DOCUMENTS

CH 514058 A * 10/1971
FR 2737525 A1 * 2/1997 ..... E01F 9/685
(Continued)

OTHER PUBLICATIONS durisol.com—Mash TL-4 Crash Tested Noise Barrier Product Guide, May 2021, retrieved from https://www.durisol.com/wp-content/uploads/2021/05/MASH-TL-4-Product-Guide-EN-DRAFT2-002.pdf.
(Continued)

*Primary Examiner* — Jonathan P Masinick
(74) *Attorney, Agent, or Firm* — Mintz Levin Cohn Ferris Glovsky and Popeo, P.C.

(57) ABSTRACT

A lateral support device for stabilizing an elongate foundation post installed in a substrate. The lateral support device may include at least one engagement member for engaging the elongate foundation post. The lateral support device may also include a support plate extending from the at least one engagement member. The support plate may have a plate width greater than a post width of the elongate foundation post. The support plate may be slidable relative to the foundation post in an elongate direction when the at least one engagement member engages at least a portion of the
(Continued)

elongate foundation post. When the engagement member is in an engaged position, at least a portion of the support plate is below the grade of the substrate.

5 Claims, 37 Drawing Sheets

(51) Int. Cl.
*E04H 17/20* (2006.01)
*E04H 17/26* (2006.01)

(58) Field of Classification Search
CPC ..... E04H 17/08; E04H 17/20; E04H 17/22; E04H 17/23; E04H 17/263; E01F 8/0023; E01F 8/0005
See application file for complete search history.

(56) References Cited

U.S. PATENT DOCUMENTS 444,781 A * 1/1891 Minnick ..... E04H 12/2215 52/154
606,558 A * 6/1898 Ketchum ..... E04H 12/2215 52/154
614,151 A * 11/1898 Webb ..... E04H 12/2215 52/153
1,142,046 A * 6/1915 Michod ..... E04H 12/2215 52/154
1,330,157 A * 2/1920 Anderson ..... E04H 17/08 52/153
1,359,704 A * 11/1920 Howell ..... E04H 17/08 52/154
1,965,994 A * 7/1934 Sommer ..... E04H 17/08 52/153
1,968,309 A * 7/1934 Paque ..... E04H 12/2215 52/153
2,189,542 A * 2/1940 Caldwell ..... E04H 12/2215 52/153
3,011,598 A 12/1961 Galloway et al.
3,417,525 A * 12/1968 Dashio ..... E02D 7/30 52/298
3,775,924 A 12/1973 Mcclure
3,896,596 A 7/1975 Berger
4,027,856 A * 6/1977 Kingsley ..... E04H 12/2215 52/155
4,249,715 A 2/1981 Repp
5,058,337 A * 10/1991 O'Connor ..... A01G 17/14 52/155
5,104,265 A * 4/1992 Halloran, Jr. ..... E04H 12/2215 405/253
5,613,329 A 3/1997 Land et al.
6,474,028 B2 11/2002 Cusimano et al.
6,540,196 B1 4/2003 Ellsworth
6,666,625 B2 * 12/2003 Thornton ..... E04H 12/2215 405/262
7,040,416 B2 * 5/2006 Collins ..... E04H 17/263 175/57
8,322,678 B2 * 12/2012 Zhu ..... E04H 17/22 248/516
9,506,210 B2 * 11/2016 Southworth ..... E02D 5/14
9,574,795 B2 * 2/2017 Kelleher ..... F24S 25/617
9,657,493 B2 * 5/2017 Finnegan ..... E04H 12/2215
10,398,093 B2 * 9/2019 Bahler ..... E02D 5/80
10,472,851 B1 * 11/2019 Brislin ..... E04H 17/08
11,441,284 B2 * 9/2022 Caron ..... G01C 15/02
2002/0195273 A1 * 12/2002 Collins ..... E04H 17/263 175/320
2005/0265780 A1 12/2005 Humphries et al.
2008/0302028 A1 12/2008 Lewenhoff
2012/0104190 A1 * 5/2012 Parent ..... E04H 12/2223 248/156

FOREIGN PATENT DOCUMENTS

KR 20040081683 A * 9/2004
KR 20110087354 A * 8/2011
KR 101107784 B1 * 1/2012
KR 101132415 B1 * 4/2012
KR 101166141 B1 * 7/2012
KR 101252677 B1 * 4/2013
KR 20130087137 A * 8/2013
KR 20140132129 A * 11/2014
WO 2014082758 A1 6/2014
WO 2015059579 A2 4/2015

OTHER PUBLICATIONS

PCT, Written Opinion and International Search Report of International Application No. PCT/CA2020/050077, mailing date Apr. 8, 2020.

* cited by examiner

POST FOR A SOUND WALL AND SOUND WALL EMPLOYING THE SAME

CROSS REFERENCE TO RELATED APPLICATIONS

This application claims priority from U.S. provisional patent application No. 62/795,724, filed on Jan. 23, 2019, the entire contents of which are hereby incorporated by reference herein.

FIELD

The subject disclosure relates to elongate posts and sound walls employing the same, and in particular to elongate posts and support devices for stabilizing the elongate posts.

BACKGROUND

High traffic through fares, such as highways, railroads and the like, produce significant noise. In urban centers, buildings such as housing developments and businesses are often built proximate to the through fares and as a result, require protection from noise and require privacy. To provide the desired noise protection and privacy, it is common to erect sound walls or barriers (sometimes referred to as anti-noise or acoustic walls or barriers) along stretches of through fares, primarily in urban centers, to deflect and/or dampen sound resulting from vehicular traffic and to provide privacy.

For example, Canadian Patent No. 2,146,110 discloses a sound barrier including a wall having a series of adjacent elongate boards joined with overlapping sealed joints. The first and last boards in the series define first and second generally parallel side edges respectively. The series of boards further defines a lower edge extending between the first and second side edges. At least one rail is attached to the wall and extends between the first and second side edges. A skirt extends between the first and second side edges and below the lower edge. First and second generally parallel posts are mounted below the ground in concrete (cement) footings. The first post has a lengthwise groove which is adapted to receive the first edge of the wall, and the second post has a lengthwise groove which is adapted to receive the second edge of the wall. The panels are constructed from boards, upper rails, middle rails, lower rails, and a skirt. The boards are formed of wood, particle board, wafer board, plastic, and the like.

Canadian Patent No. 2,148,877 discloses an elongated outdoor acoustic barrier for erection along a roadway or the periphery of an airport, for reflecting and absorbing sounds emanating from the roadway or airport. The acoustic barrier includes a plurality of substantially vertical columns arrayed at spaced intervals along the length of the acoustic barrier with the lower ends of the vertical columns anchored in large cylindrical concrete caissons. Each vertical column has a recessed groove extending along its exposed above-ground lateral surface facing an adjacent spaced column. A plurality of elongated flat rectangular panels is arranged in a vertical edgewise array. Opposite ends of each panel are securely received in the recessed grooves of a pair of adjacent columns. At least one of the panels is an extruded prestressed hollow core concrete panel.

While sound walls of the types described above are useful, they do suffer drawbacks. For example, during construction of the sound walls, embedding the vertical posts or columns into the concrete footings is expensive both in terms of time and money. As will be appreciated, the concrete footings must cure before the sound wall panels can be installed. Also, the concrete footings must be mixed and casted on site. This makes the process of embedding the vertical posts or columns into the concrete footings typically the most expensive part of the sound wall construction.

Once constructed, in addition to their own weight the sound walls can be subjected to significant external environmentally induced loads or forces, such as lateral wind loads, that act to tilt/tip the sound walls as well as adfreeze loads (i.e. frost heaving). For posts embedded in concrete footings, the posts' resistance to tilting/tipping is a function of the type of earth formation into which the concrete footings are sunk and the diameter of the concrete footings. While increasing the diameter of the concrete footings provides for greater resistance to tilting/tipping, doing so results in further increased costs, especially in situations where the sound walls extend along significant lengths.

Sound walls that avoid the use of concrete footings have been considered. For example, U.S. Patent Application Publication No. 2013/0180799 discloses a supporting structure for an anti-noise barrier. The supporting structure is in the form of an S-shaped sheet pile. The sheet pile has a first part and a second part of such a length that, in use, the second part of the sheet pile is insertable into the ground to form the supporting structure foundation, while the first part of the sheet pile emerges from the ground upwards. The first part of the sheet pile is provided with connection means through which sound-absorbent panels can be connected.

SUMMARY

Lateral support devices for stabilizing elongate foundation posts installed in a substrate are provided. Embodiments of lateral support devices described in the present application may increase lateral load support without requiring substantial increases in elongate length of foundation posts. The lateral support devices of the present application includes features, which in some situations, may stabilize the elongate foundation posts whilst minimizing disturbance of the substrate during installation of foundation posts and associated lateral support devices. When the lateral support devices engage foundation posts installed in the ground, the lateral support devices may be slidable relative to the foundation post and may be positioned or fixed at desired substrate elevations, thereby increasing positional precision with which the foundation posts or lateral support devices may be installed.

As the lateral support devices may be installed as one or more separate components from the foundation posts, in some scenarios, features of the lateral support devices or types of lateral support devices for stabilizing foundation posts may be dynamically selected based on characteristics of the substrate at an installation site or the desirable elevation position at which the lateral support device may be installed. Further, as the lateral support devices in some embodiments of the present application may not be coupled to or affixed to foundation posts until a foundation post is installed in a substrate, efficiencies in transporting the lateral support devices and the foundation posts from manufacturing facilities to installation sites may be increased.

In one aspect, the present application may provide a lateral support device for stabilizing an elongate foundation post installed in a substrate. The lateral support device may include: at least one engagement member for engaging the elongate foundation post; and a support plate extending from the at least one engagement member. The support plate may have a plate width greater than a post width of the elongate foundation post. The support plate may be slidable relative to the foundation post in an elongate direction when the at least one engagement member engages at least a portion of the elongate foundation post. When the engagement member is in an engaged position, at least a portion of the support plate may be below the grade of the substrate.

In some embodiments, the lateral support device includes a fastener for fastening at least one of the engagement member or the support plate to the elongate foundation post below the grade.

In some embodiments, the at least one engagement member includes a hollow section defining a sleeve insertable over an end of the foundation post.

In some embodiments, the foundation post is an H-beam having a flange, and wherein the at least one engagement member includes one or more cantilevered protrusions extending from the support plate for engaging the flange.

In some embodiments, the support plate includes an elongate slot for slidable engagement with a support plate anchor affixed to the elongate foundation post below the grade.

In some embodiments, the elongate foundation post includes a post aperture, and wherein the at least one engagement member includes an member aperture for aligning with the post aperture and engaging a fastener for securing the support plate below the grade.

In some embodiments, the fastener includes at least one of a pin or a screw-nut combination for receipt in the aligned member aperture and post aperture.

In some embodiments, the lateral support includes a base plate coupled to the at least one engagement member for supporting a support post positioned above the grade, wherein the base plate includes a base aperture aligning with the post aperture and the member aperture for collectively engaging a fastener to secure the base plate to the combination of the elongate foundation post and the at least one engagement member.

In some embodiments, the at least one engagement member includes a snap-fit fastener for engaging with a corresponding snap-fit fastener on the elongate foundation post.

In some embodiments, the at least one engagement member has an elongate dimension in the longitudinal direction less than an elongate length of the foundation post.

In some embodiments, the support plate device includes a plurality of support plate portions, and wherein one of the plurality of support plate portions extending from the at least one engagement member is positioned in a plane different than another one of the plurality of support plate portions.

In some embodiments, the lateral support device includes a weldment affixed to the at least one engagement member for placement at the end of the elongate foundation post.

In some embodiments, the lateral support includes an uplift resist formation extending from at least one of the at least one engagement member or the support plate.

In some embodiments, the uplift resist formation includes at least one of a barb, a tap, a hole, or a punch-out.

In another aspect, the present application may provide method of assembling a foundation post assembly in a substrate. The foundation post assembly may include a lateral support assembly having an engagement member and a support plate extending from the engagement member. The method may include inserting an elongate foundation post into the substrate; aligning the lateral support assembly to be proximal to a grade end of the elongate foundation post; and inserting the lateral support assembly to engage the engagement member with the elongate foundation post, such that at least a portion of the support plate is below grade of the substrate. The lateral support assembly may be in slidable engagement in an elongate direction with the elongate foundation post.

In some embodiments, inserting the elongate foundation post into the substrate is subsequent to inserting the lateral support assembly into the substrate at a target position.

In some embodiments, inserting the elongate foundation post into the substrate includes inserting the elongate foundation post until the grade end of the elongate foundation post is proximal to a grade of the substrate.

In some embodiments, the elongate foundation post includes a pile aperture at the grade end of the elongate foundation post, and wherein the engagement member includes a support aperture, and wherein the method includes: aligning the pile aperture and the support aperture, and inserting a fastener within the aligned pile aperture and support aperture to secure the lateral support assembly below the grade of the substrate.

In some embodiments, the method includes fastening at least one of the engagement member or the support plate of the lateral support assembly to the elongate foundation post at a position below the grade.

In some embodiments, the elongate foundation post includes at least one of an H-beam, an I-beam, or a hollow pile, and wherein inserting the elongate foundation post into the substrate includes driving the elongate foundation post or vibrating the elongate foundation post.

In some embodiments, the elongate foundation post includes at least one of a screw pile or a helical pile, and wherein inserting the elongate foundation post includes rotationally driving the elongate foundation post into the substrate.

In another aspect, the present application may provide a foundation post assembly. The foundation post assembly may include: an elongate foundation post for positioning in a substrate and a lateral support assembly engaging the elongate foundation post. The lateral support assembly may include: at least one engagement member for engaging the elongate foundation post; and a support plate extending from the at least one engagement member, the support plate having a plate width greater than a post width of the elongate foundation post, and wherein the support plate is slidable relative to the foundation post in an elongate direction when the at least one engagement member engages at least a portion of the foundation post. When the engagement member is in an engaged position, at least a portion of the support plate may be below the grade of the substrate. The foundation post assembly may include: a base plate coupled to the at least one engagement member for engaging the combination of the lateral support assembly and the elongate foundation post; and a support post positioned on the base plate and positioned above the grade of the substrate.

In some embodiments, the foundation post assembly includes a fastener for fastening at least one of the engagement member or the support plate to the elongate foundation post at a position below the grade.

In some embodiments, the support plate is included in a pair of support plates, wherein the pair of support plates are affixed to opposing sides of the engagement member and at staggered position in an elongate direction of the elongate foundation post.

In some embodiments, the lateral support assembly, the base plate, and the support post form a substantially unitary component.

In some embodiments, the lateral support assembly is included in a series of lateral support assemblies engaging the elongate foundation post at different positions along the elongate foundation post.

BRIEF DESCRIPTION OF DRAWINGS

Embodiments will now be described more fully with reference to the accompanying drawings in which.

DETAILED DESCRIPTION

Figure 1:
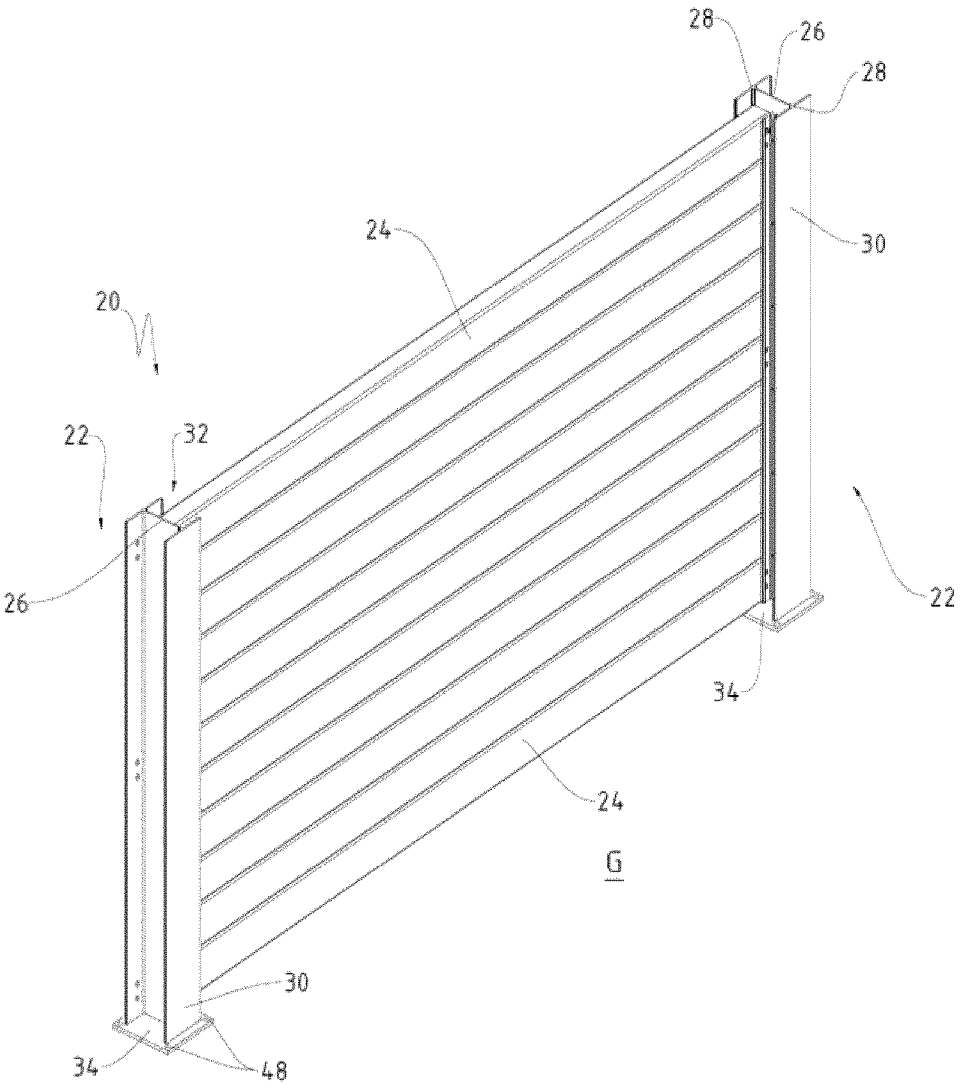
FIG. 1 is a perspective view of a sound wall.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "affixed" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly affixed" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and/or implementation of the subject matter according to the subject disclosure. Thus, the phrases "an example," "another example," and similar language throughout the subject disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to."

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of a lower-numbered item (e.g., a "first" item) and/or a higher-numbered item (e.g., a "third" item).

As used herein, the terms "approximately", "about", "substantially", and "generally" represent an amount close to the stated amount or a deviation from a strict definition that still results in the desired function or result being performed or achieved. For example, the terms "approximately", "about", "substantially", and "generally" may refer to an amount or deviation that is within engineering tolerances and that would be readily appreciated by a person of ordinary skill in the art.

In the following, various embodiments of a post are described with reference to the figures. The post is configured to be installed into an earth formation using a vibratory or mechanical pile driver or other suitable equipment and avoid the need for a concrete footing while providing good resistance to tilting/tipping. In some embodiments, the post comprises an elongate beam member at least having a web and at least one flange extending along an edge of the web. The at least one flange is arranged generally at a right angle to the web and presents a generally planar, outer surface. At least one plate member is affixed to the outer surface of the at least one flange. The at least one plate member lies in a plane generally parallel to the plane of the at least one flange, and extends beyond at least one side edge of the at least one flange. When the elongate beam member is driven into the earth formation, at least a portion of the at least one plate member extends below grade.

Embodiments of a sound wall employing support posts are also described with reference to the figures. In some embodiments, the sound wall comprises a plurality of laterally spaced, generally vertical, support posts. Each support post comprises a lower portion extending into the earth formation and an upper portion extending upwardly from the earth formation. A plurality of stacked, elongate panels extends between the upper portions of the support posts. The upper portion of each of the support posts is configured to receive respective ends of the panels. The lower portion of each of the support posts carries at least one plate member configured to resist forces imparted on the sound wall, by for example lateral wind loads, that act to tip/tilt the sound wall. Further specifics concerning the post and sound wall employing the same will now be described.

Turning now to FIG. 1, a sound wall configured to deflect and/or dampen sound is shown and is generally identified by reference numeral 20. In this embodiment, the sound wall 20 comprises a pair of laterally spaced, generally vertical, multi-component support posts. Each support post comprises a foundation post 50 (see FIGS. 2 to 9) that extends into an underlying earth formation (i.e. the ground G) and an upright post 22 mounted on the foundation post 50 that extends upwardly from the ground G. A plurality of stacked, elongate, sound deflecting or dampening panels 24 extends between the upright posts 22. In this embodiment, the elongate panels 24 are formed of plastic material such as polyvinylchloride (PVC) and carry mating formations (e.g. tongue and groove formations) that allow the elongate panels 24 to fit together (align and interlock) and avoid openings between the elongate panels through which sound can pass unimpeded. One or more of the elongate panels 24 may be filled with light weight concrete, rockwall, expanded polystyrene (EPS) foam, etc. or may accommodate an elongate stiffener to combat vertical and horizontal deflection of the elongate panels 24 and inhibit sagging. Although the sound wall 20 in FIG. 1 is shown as comprising two laterally spaced, vertically disposed support posts with elongate panels 24 extending therebetween, those of skill in the art will appreciate that this is for ease of illustration. In a typical sound wall installation, the sound wall 20 will span a significant distance and will comprise a series of laterally spaced, generally vertical, support posts, with elongate panels 24 extending between each pair of adjacent support posts.

In this embodiment, each of the upright posts 22 comprises an elongate beam member in the form of an H-beam or an I-beam formed of steel or other suitable structural material. As a result, each upright post 22 comprises a central web 26, and a pair of generally parallel flanges 28 extending along opposite edges of the central web 26. The flanges 28 are generally at right angles to the central web 26 and present oppositely facing, generally planar, outer surfaces 30. At opposite sides of each upright post 22, the central web 26 and the flanges 28 define channels 32. The facing channels 32 of the upright posts 22 receive the ends of the elongate panels 24. A generally rectangular mounting base 34 is provided at the bottom of each upright post 22. The mounting bases 34 are secured to the foundation posts 50 as will be described.

Turning now to FIGS. 2 to 9, one of the foundation posts 50 is illustrated. As can be seen, the foundation post 50 also comprises an elongate beam member 52 formed of steel or other suitable structural material. In this embodiment, the elongate beam member 52 may be similar in configuration to the elongate beam members of the upright posts 22 and may be in the form of an H-beam or an I-beam. As a result, the elongate beam member 52 comprises a central web 54, and a pair of generally parallel flanges 56 extending along opposite edges of the central web 54. The flanges 56 may be generally at right angles to the central web 54 and present oppositely facing, generally planar outer surfaces 58. At opposite sides of the elongate beam member 52, the central web 54 and the flanges 52 may define channels 60.

Figure 2:
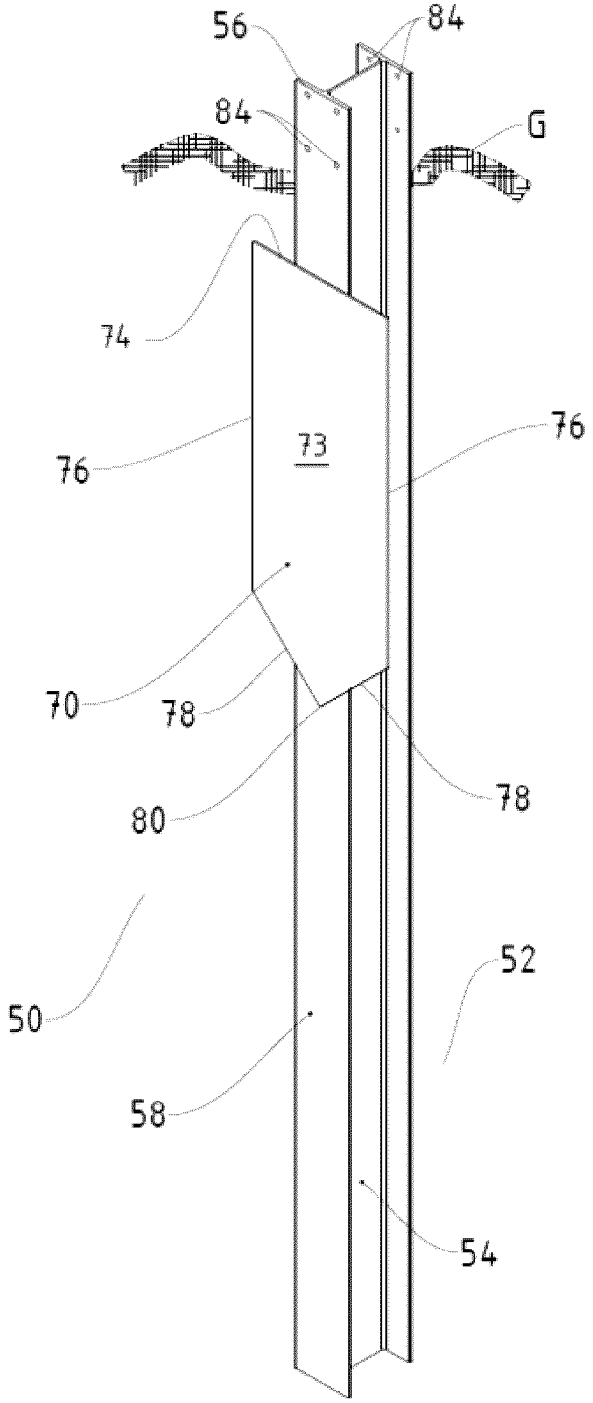
FIG. 2 is a front perspective view of a foundation post forming part of the sound wall of FIG. 1.
Figure 3:
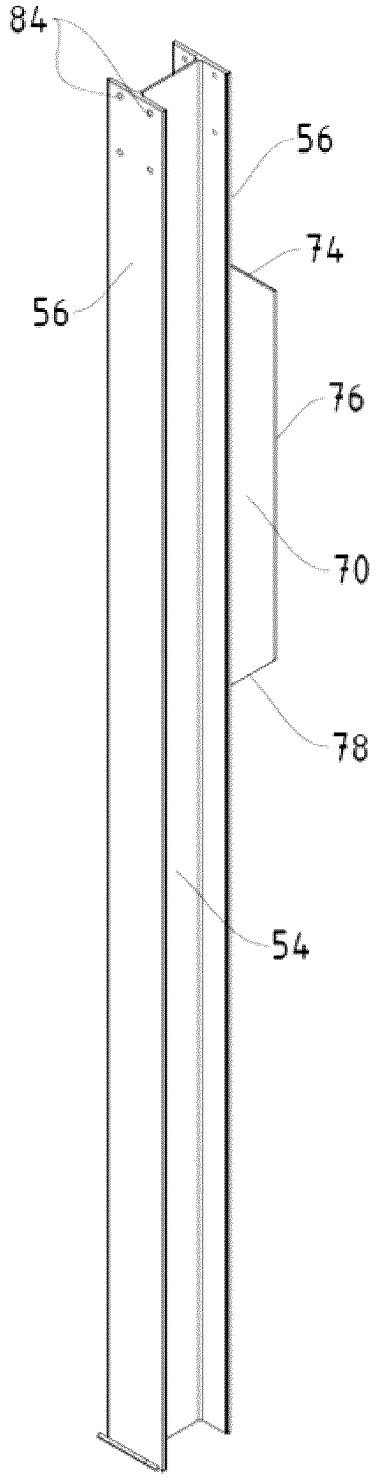
FIG. 3 is a rear perspective view of the foundation post of FIG. 2.
Figure 4:
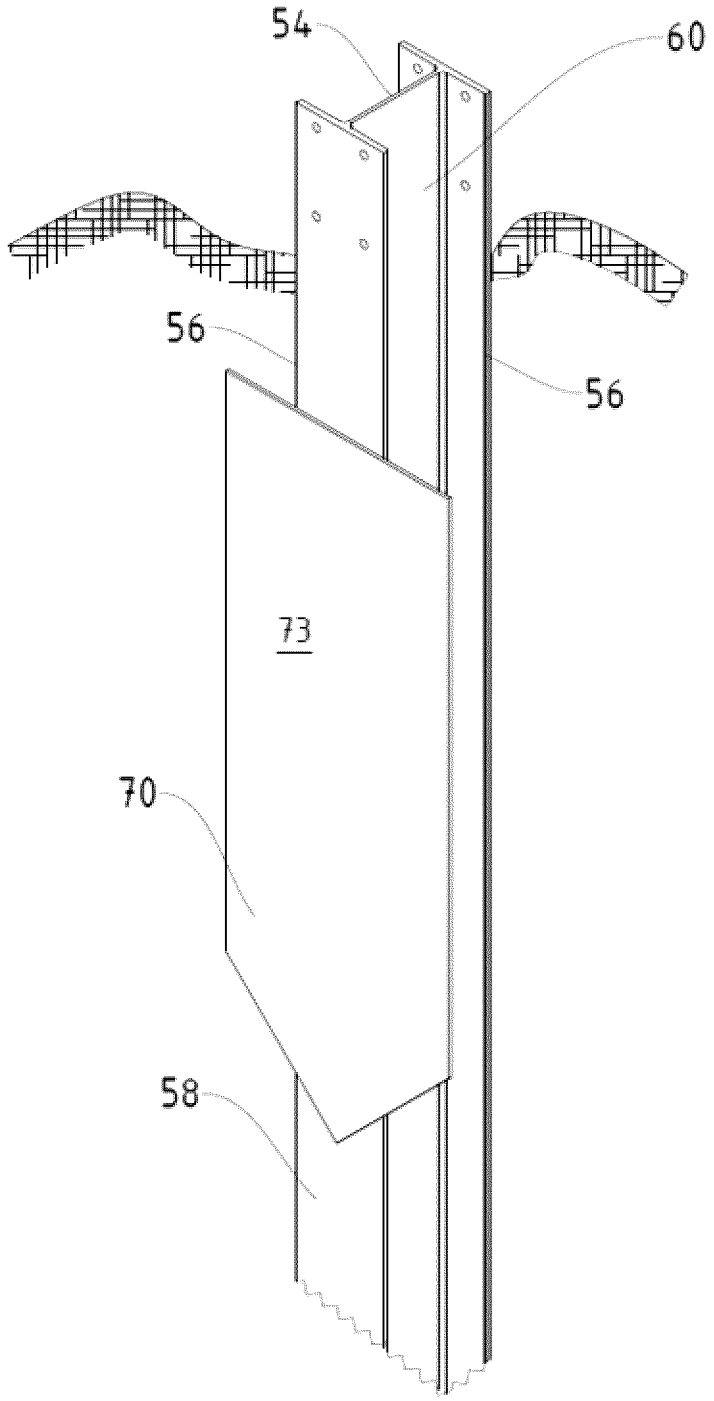
FIG. 4 is an enlarged front perspective view of a portion of the foundation post.
Figure 5:
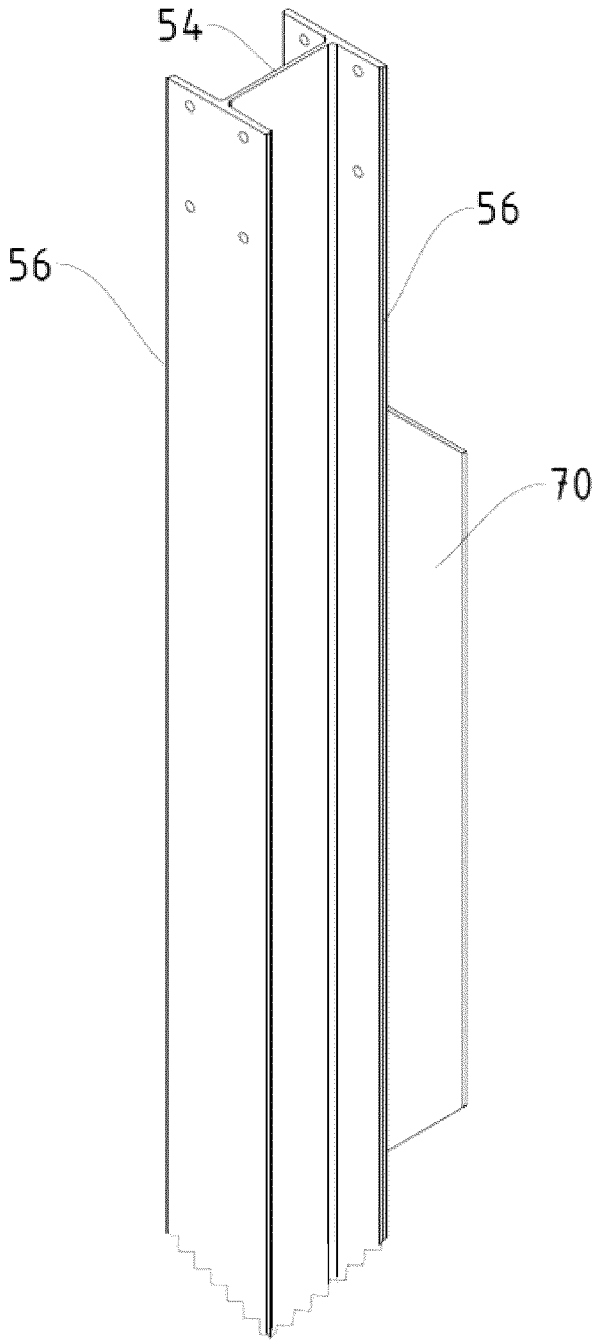
FIG. 5 is an enlarged rear perspective view of a portion of the foundation post.
Figure 6:
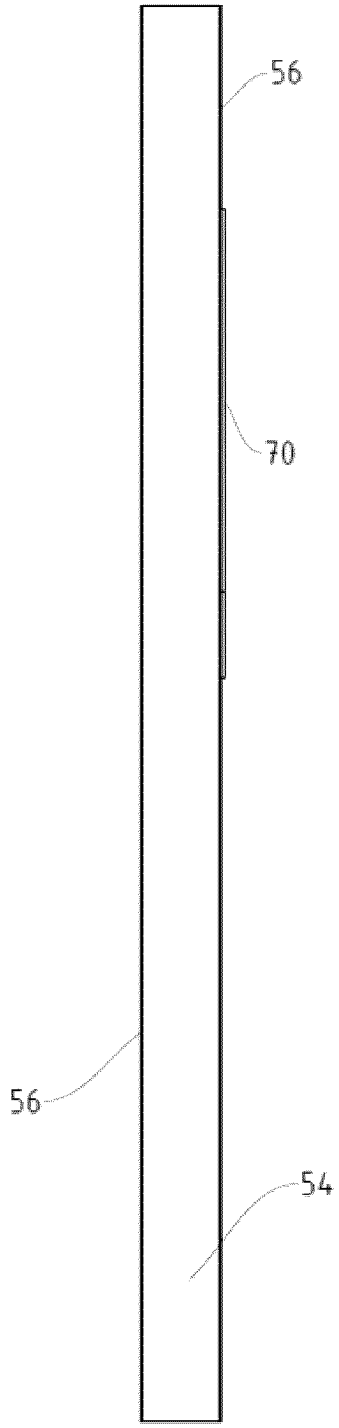
FIG. 6 is a side elevation view of the foundation post, the opposite side elevation view being a mirror image.
Figure 7:
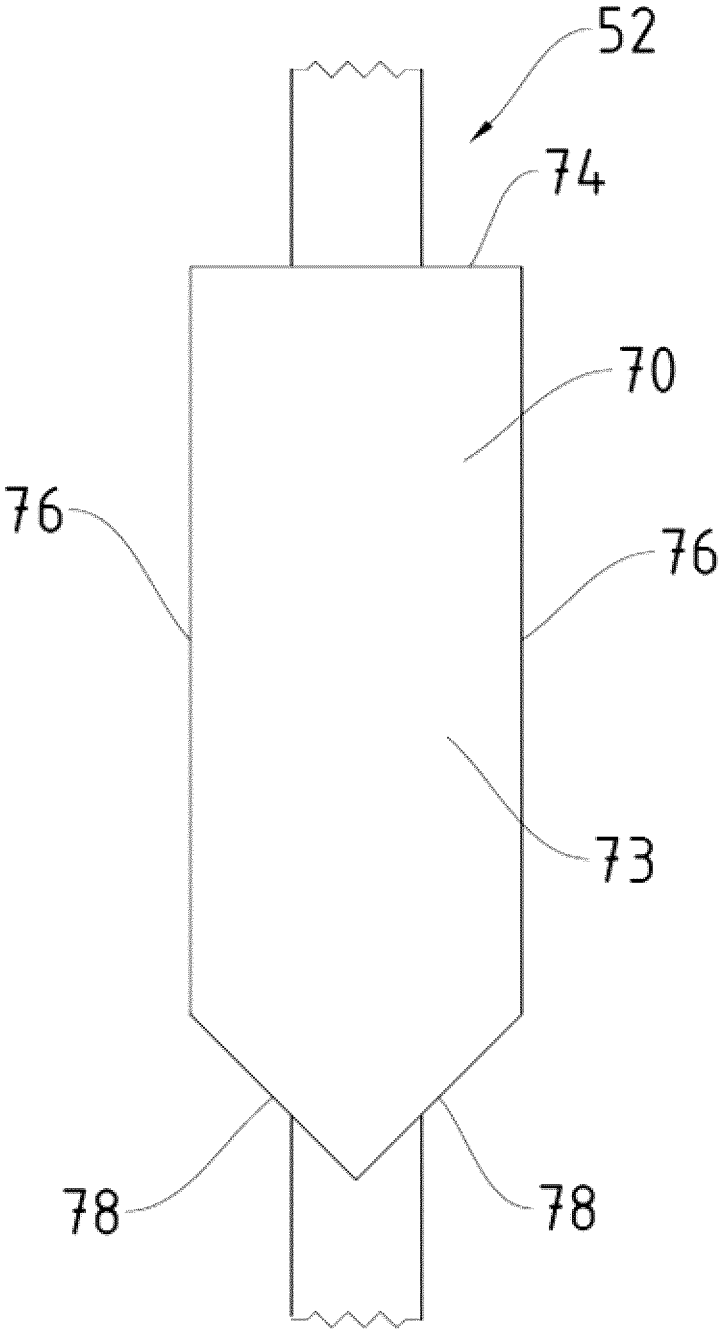
FIG. 7 is a front elevation view of a portion of the foundation post.
Figure 8:
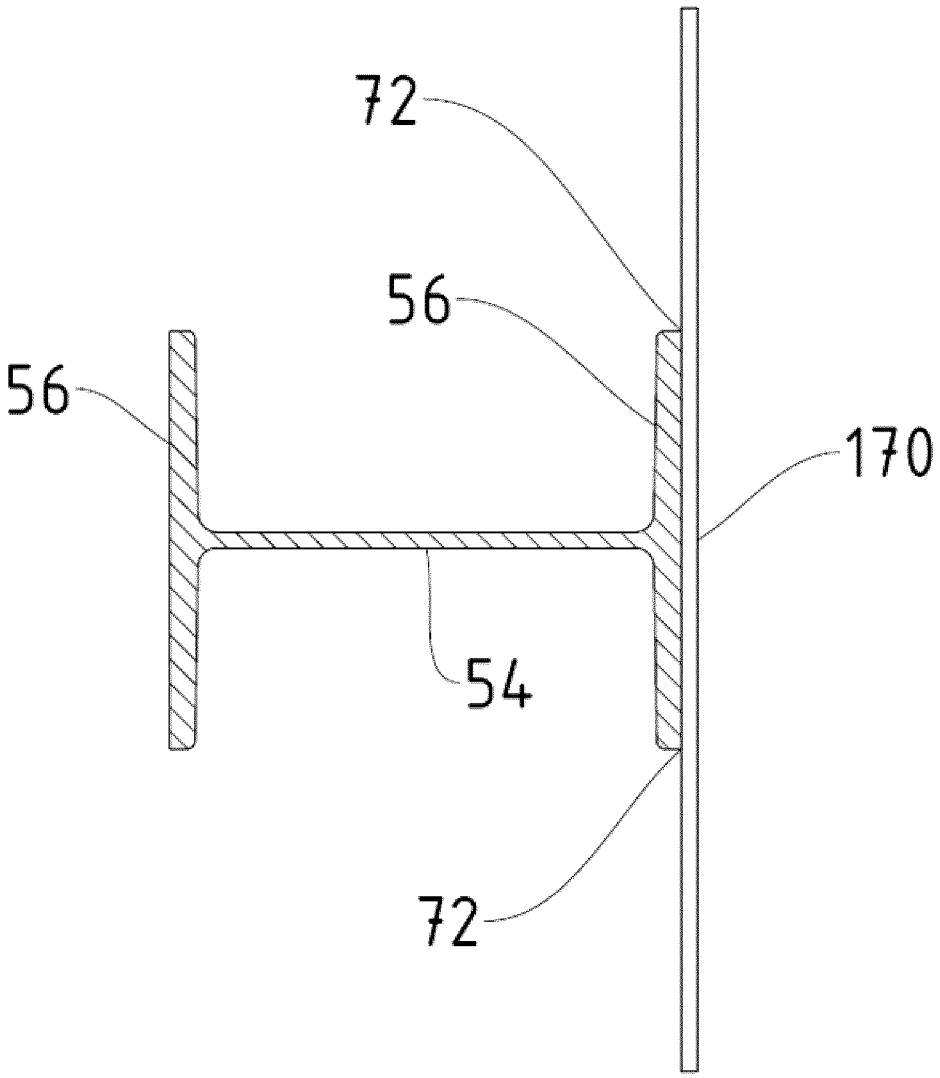
FIG. 8 is a cross-sectional view of the foundation post.
Figure 9:
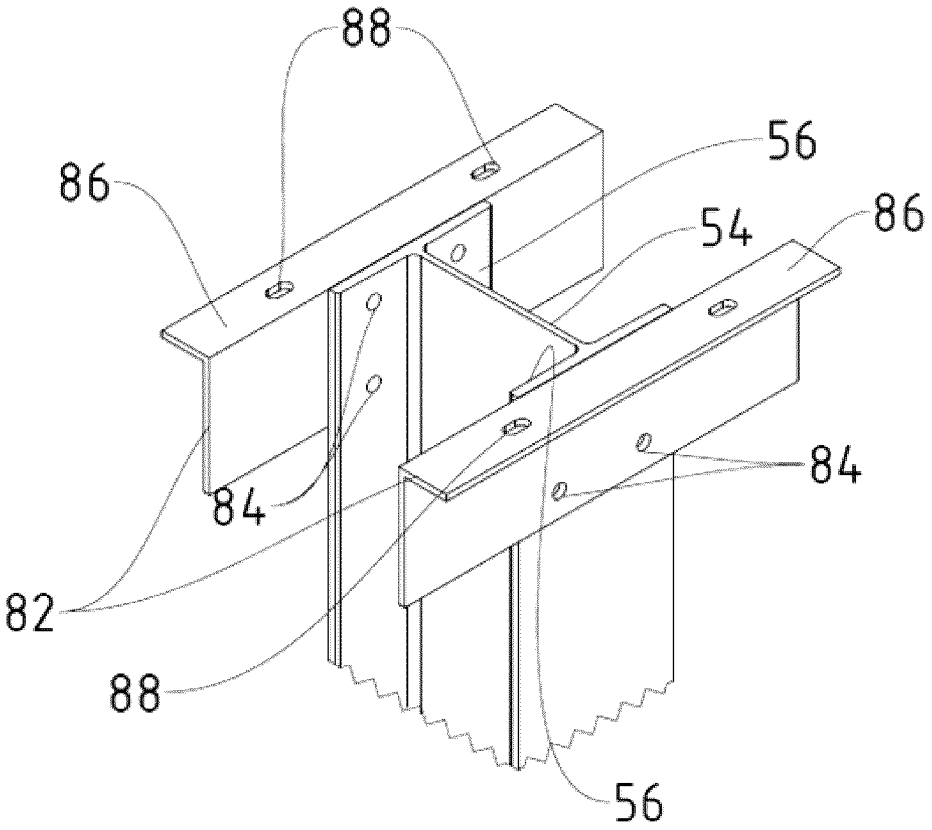
FIG. 9 is a perspective view of interface angles connected to the top of the foundation post.

A generally planar, plate or paddle member 70 also formed of steel or other suitable structural material may abut and may be affixed to one of the flanges 56 by welds 72 (see FIG. 8) or other suitable fastening structure (e.g. bolts, rivets etc.). The plate member 70 may present an outwardly facing, major surface 73 and may be positioned intermediate the length of the beam member 52 but nearer the upper end of the foundation post 50. The plate member 70 may lie in a plane that is substantially parallel to the plane of the flange 56 to which it is affixed. In this embodiment, the plate member 70 may include a width that extends beyond opposite side edges of the flange 56. The plate member 70 may include an upper edge 74 that extends generally transverse to the longitudinal axis of the foundation post 50, side edges 76 that may extend downwardly from opposite ends of the upper edge 74 and parallel to the longitudinal axis of the foundation post 50, and bottom edges 78 that may extend downwardly and inwardly from the sides edges 76 and may converge at a point 80 as shown in FIG. 2, FIG. 4 and FIG. 7.

An interface angle 82 (see FIG. 9) may be connected to each flange 56 adjacent the upper end of the foundation post 50 by fasteners (not shown) that pass through matching sets of holes 84 provided in the flanges 56 and interface angles 82, respectively. Each interface angle 82 may present a generally planar, horizontal support surface 86 having a pair of laterally spaced, elongate slots 88 therein.

Each mounting base 34 may overlie the support surfaces 86 of the interface angles 82 connected to the respective foundation post 50 and may be secured to the interface angles 82 by suitable fasteners (not shown), such as nuts and bolts. The fasteners may pass through holes 48 in the mounting base 34 that are aligned with the elongate slots 88 in the support surfaces 86.

During installation, the foundation posts 50 may be driven into the ground G using a vibratory pile driver, impact pile driver or other suitable equipment at the desired laterally spaced locations. In particular, the foundation posts 50 may be driven into the ground G until the support surfaces 86 of the interface angles 82 are at or slightly above the surface of the ground G (i.e. grade). In this manner, the upper edge 74 of the plate member 70 of each foundation post 50 may be just below the surface of the ground G. The pointed and symmetrical configuration of the plate members 70 may help to reduce twisting of the foundation posts 50 when being vibrated into the ground G thereby to facilitate installation of the foundation posts 50. The upright posts 22 may be secured to the foundation posts 50 by positioning the mounting bases 34 over the support surfaces 86 of the interface angles 82, passing the fasteners 90 through the holes 48 in the mounting bases 34 and through the aligned elongate slots 88 in the support surfaces 86 and then tightening the fasteners. With the upright posts 22 secured to the foundation posts 50, the elongate panels 24 may be installed between the upright posts 22. This may be achieved by positioning each elongate panel 24 above the upright posts 22 with the ends of the elongate panels in line with the facing channels 32 and lowering each elongate panel 24 so that opposite ends of the elongate panel are accommodated by the facing channels 32. As will be appreciated, the elongate slots 88 in the support surfaces 86 may allow the lateral spacing of the upright posts 22 to be adjusted after installation of the foundation posts 50 to facilitate insertion of the elongate panels 24 into the facing channels 32.

The plate members 70 on the foundation posts 50 may resist rocking forces imparted on the sound wall 20, by for example lateral wind loads, that act to tilt/tip the sound wall. This may allow the thickness of the foundation posts 50 to be reduced, allow the depths to which the foundation posts 50 are driven into the ground G to be reduced, and avoid the need for concrete footings. As a result, a number of advantages may be realized. For example, by avoiding the need for concrete footings, during construction of the sound wall 20, fewer construction vehicles on site may be required and virtually no spoils result that need to be removed from the construction site thereby further reducing construction vehicles that may be required. Also, by avoiding concrete footings, installation times and material costs may be decreased as delays associated with curing times are avoided. This may allow what is typically the most expensive part of sound wall construction to be avoided and as a result, allows long span sound walls to be efficiently constructed and allows sound walls to be efficiently deconstructed. This may be particularly useful when the sound walls are employed in temporary installations.

The physical configuration of the foundation posts 50 may be dependent on the nature of the ground G into which the foundation posts are installed and the maximum lateral wind loads that are expected to be imparted on the sound wall 20. The portion of the foundation posts 50 below the plate member 70 may have a length in the 4' to 6' range. In poor performing soil, larger dimension plate members 70 may be employed to increase the area of the outwardly facing, major surfaces 73 of the plate members 70. In better performing soils, such as clay, smaller dimension plate members may be employed.

Figure 10:
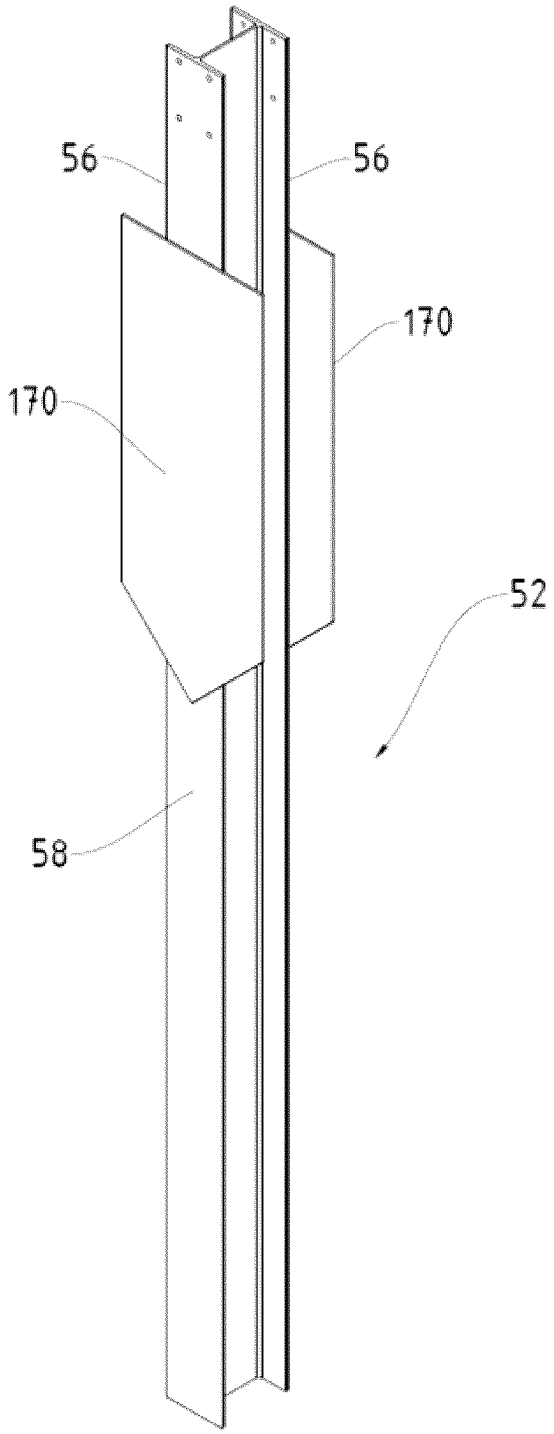
FIG. 10 is a front perspective view of an alternative foundation post for the sound wall.
Figure 11:
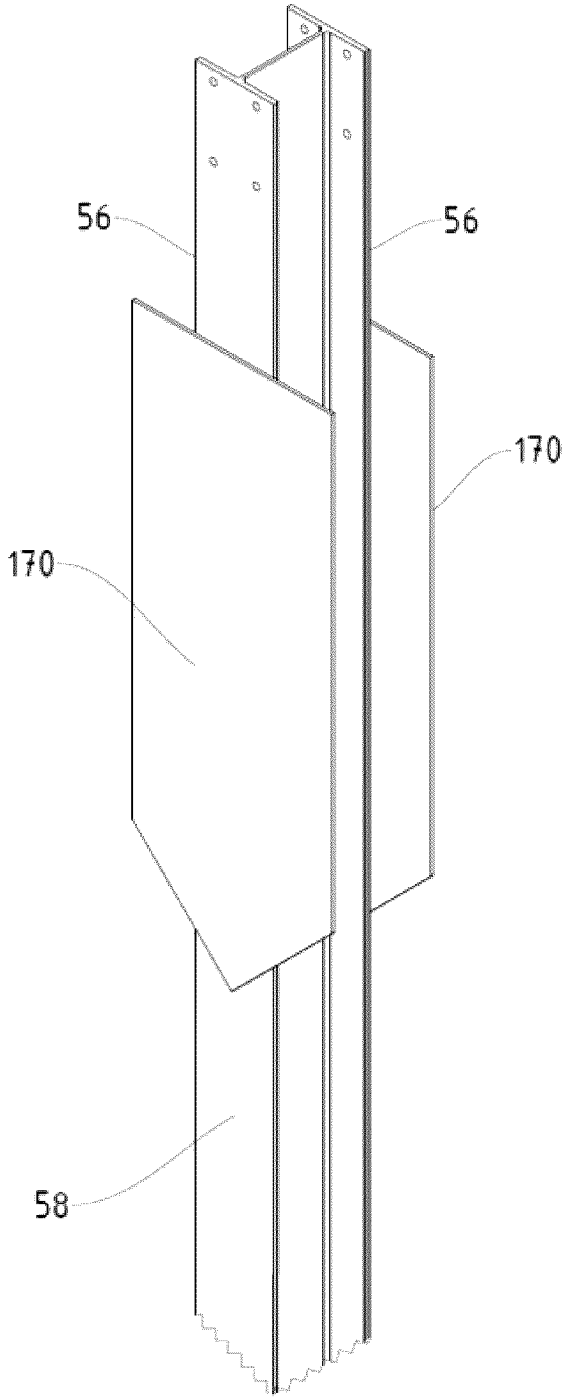
FIG. 11 is an enlarged front perspective view of a portion of the foundation post of FIG. 10.
Figure 12:
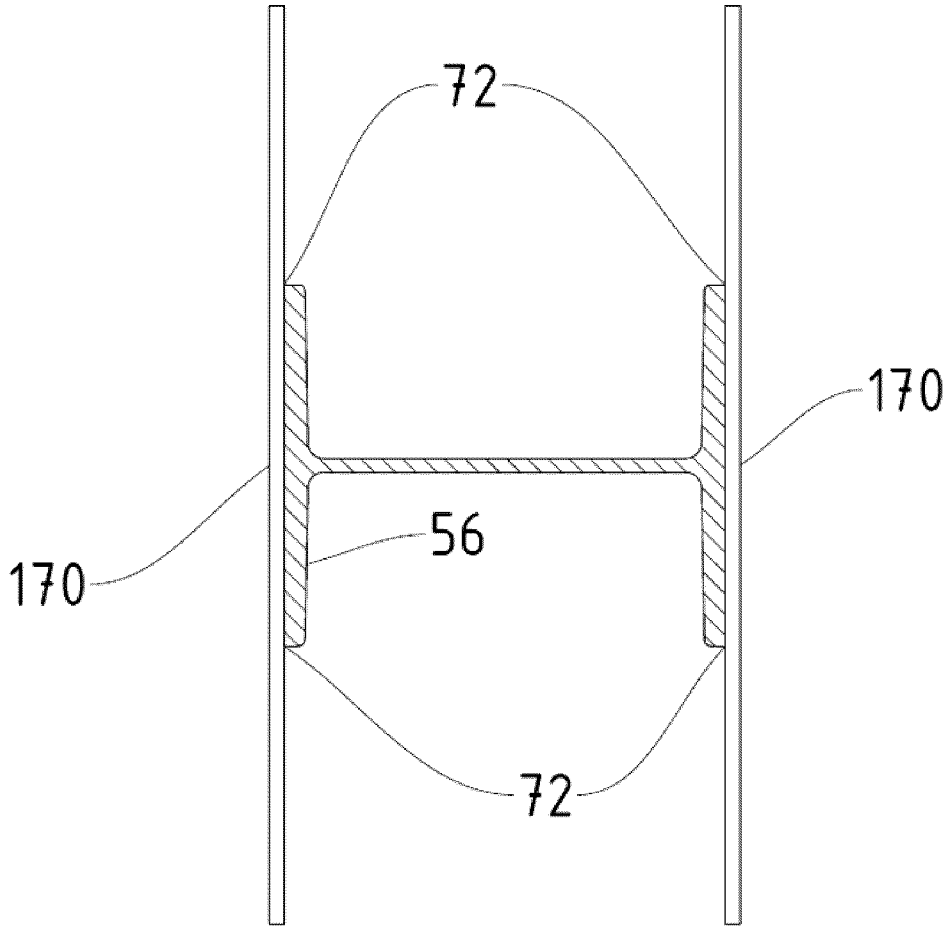
FIG. 12 is a cross-sectional view of the foundation post of FIG. 10.
Figure 13:
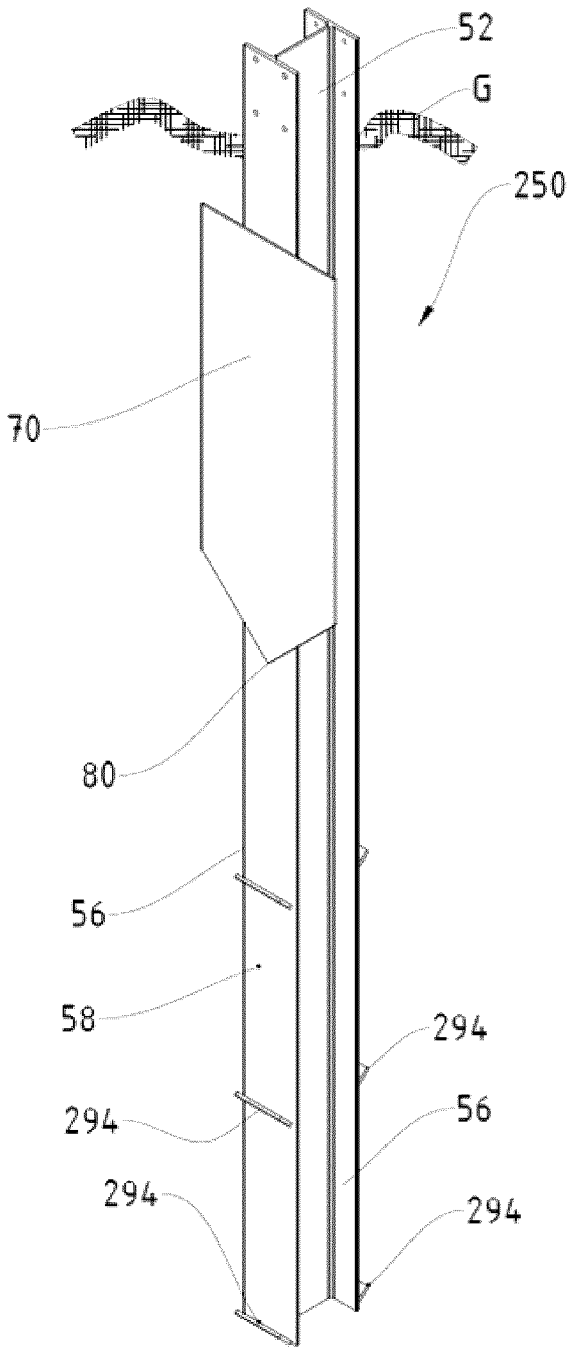
FIG. 13 is a front perspective view of yet another foundation post for the sound wall.
Figure 14:
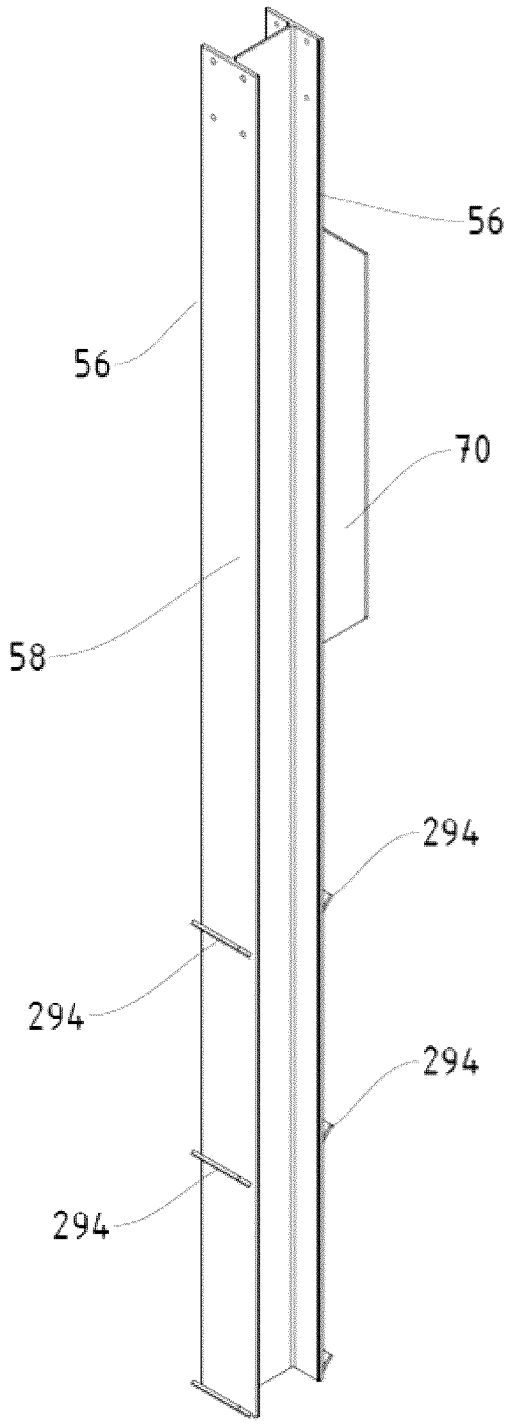
FIG. 14 is a rear perspective view of the foundation post of FIG. 13.
Figure 15:
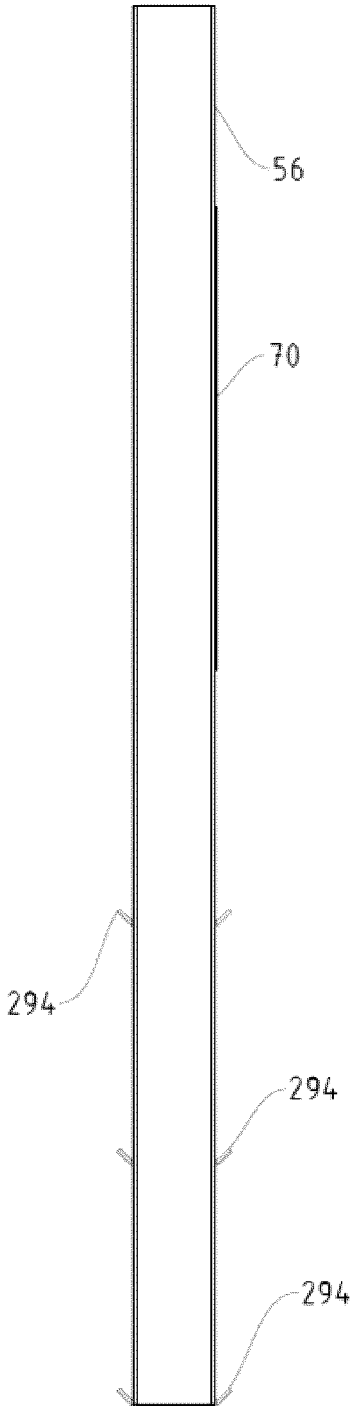
FIG. 15 is a side elevation view of the foundation post of FIG. 13, the opposite side elevation view being a mirror image.
Figure 16:
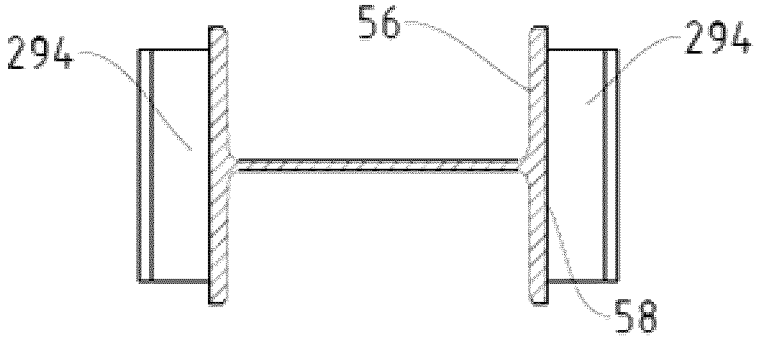
FIG. 16 is a cross-sectional view of the foundation post of FIG. 13.

In the above embodiment, each foundation post 50 is described and shown as having a single plate member 70 affixed to the outer planar surface 58 presented by one of the flanges 56. Those of skill in the art will however appreciate that alternatives may be available. For example, turning now to FIGS. 10 to 12, an alternative foundation post is shown. In this embodiment, the foundation post may be very similar to foundation post 50 with the exception that a plate member 170 may abut and may be affixed to the outer surface 58 of each of the flanges 56 by welds 72 or other suitable fastening structure. The plate members 170 in this embodiment may be positioned along the elongate beam member 52 at the same lengthwise location. If desired, the plate members 170 may be longitudinally offset (staggered) along the elongate beam member 52.

FIGS. 13 to 16 show yet another foundation post 250, in accordance with another embodiment of the present application. The foundation post 250 may be similar to foundation post 50 with the exception that a series of longitudinally spaced, uplift resist formations 294 may be provided on the outer surfaces 58 of the flanges 56 between the tip 80 of the plate member 70 and the lower end of the elongate beam member 52. In this embodiment, the uplift resist formations 294 are barbs in the form of generally rectangular bars that are welded to the flanges 56 and angled upwardly at a 45° angle. The uplift resist formations 294 may help the foundation post 250 to resist and withstand uplift adfreeze loads (i.e. frost heaving).

Figure 17:
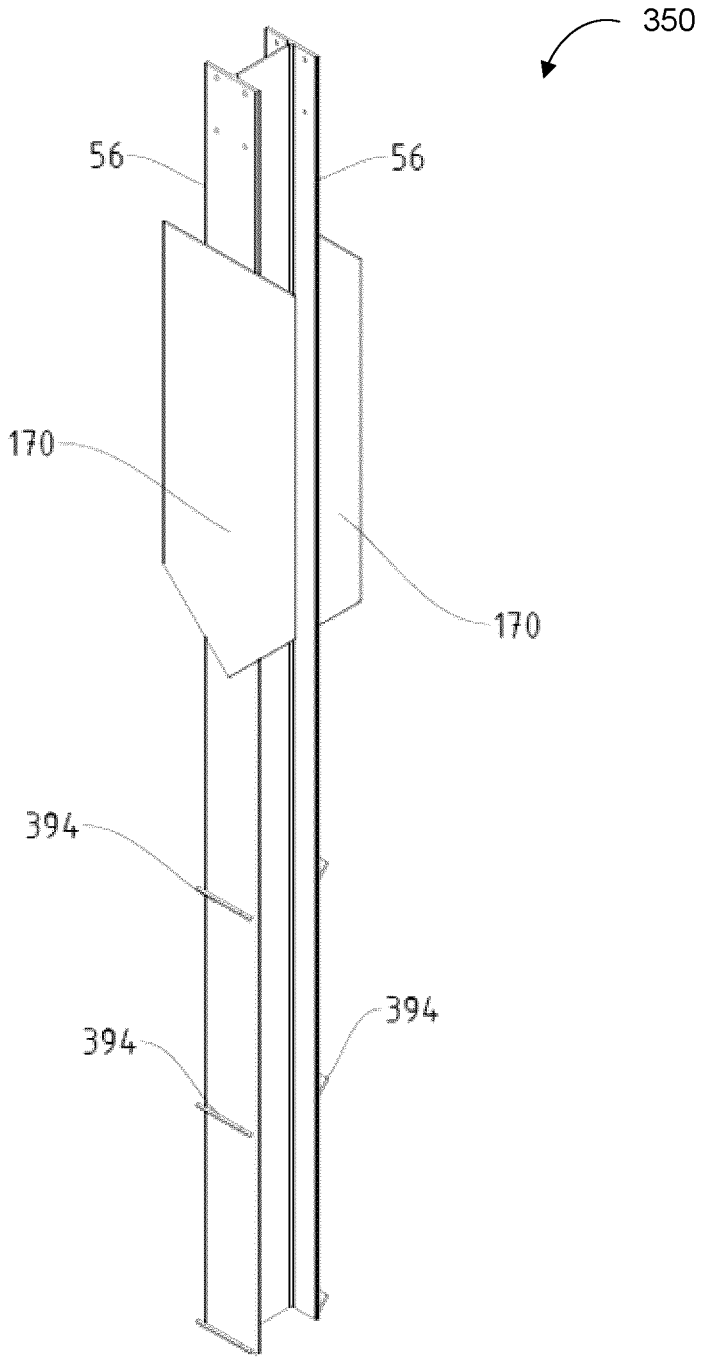
FIG. 17 is a front perspective view of yet another foundation post for the sound wall.

FIG. 17 shows still yet another foundation post 350. Foundation post 350 is very similar to foundation post 50 with the exception that a series of longitudinally spaced, transverse uplift resist formations 394 are provided on the outer surfaces 58 of the flanges 56 between the tips of the plate members 170 and the lower end of the elongate beam member.

Although various foundation posts have been shown and described, those of skill in the art will appreciate that still further alternatives are available. In some embodiments of foundation posts described herein, multiple plate members may be provided on the flange 56 at longitudinally spaced locations. In some embodiments of foundation posts described herein, multiple plate members may be provided on the flanges 56 at longitudinally spaced locations.

In FIGS. 13 to 17, although the uplift resist formations are shown as being equally spaced along the flanges and in the form of angled, transverse bars, those of skill in the art will appreciate that the number, spacing and geometric configuration of the uplift resist formations may vary. For example, the uplift resist formations may be in the form of tabs, punch-outs, holes, or a combination of barbs, tabs, punch-outs, or holes. Also, if desired, one or more uplift resist formations may be provided on the outwardly facing, major surface of the plate member(s).

Although each plate member is described and shown as being generally rectangular with a tapered bottom, in some embodiments, the plate members may take other geometric forms provided they adequately resist lateral wind loads imparted onto the sound wall 20 that act to tip/tilt the sound wall.

Figure 18:
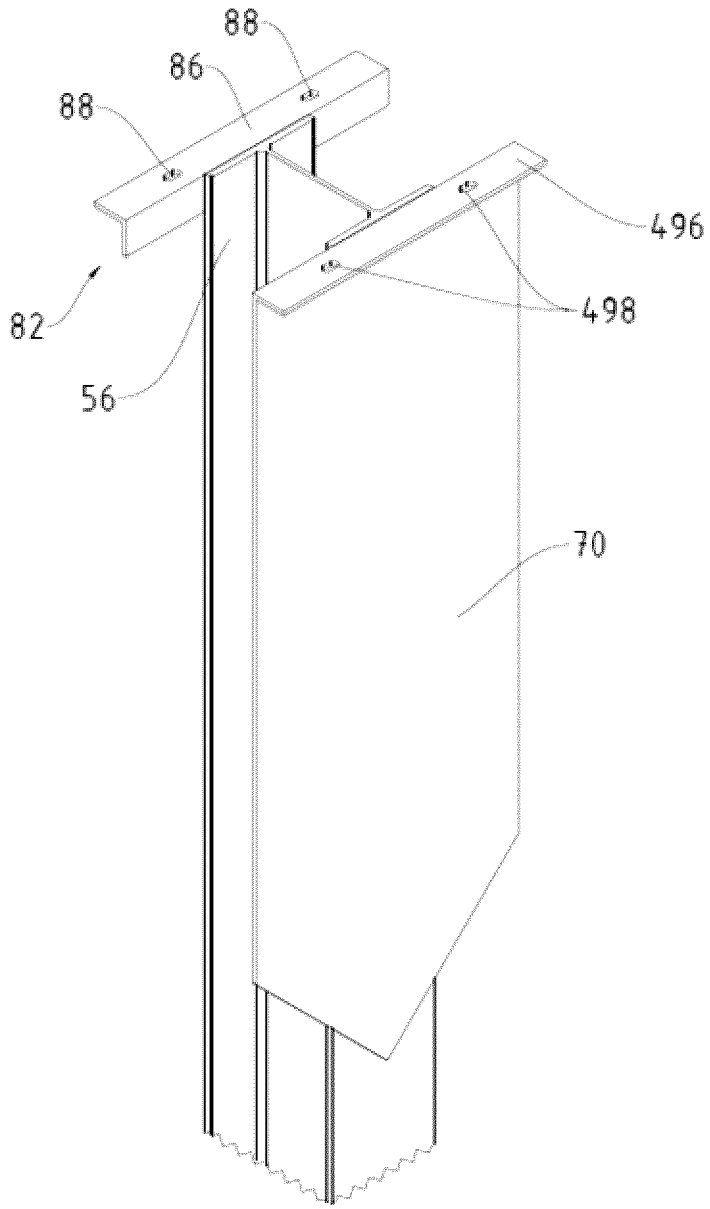
FIG. 18 is a perspective view of alternative interface angles adjacent the top of the foundation post.

In the embodiments described above, interface angles 82 may be employed at the top of the foundation posts 50 to provide support surfaces 86 for the mounting bases 34 of the upright posts 22. Those of skill in the art will appreciate that alternative interfaces between the foundation and upright posts may be employed. For example, if the foundation post comprises a single plate member 70, the plate member may be positioned along the elongate beam member 52 with its upper edge 74 adjacent the upper end of the elongate beam member 52. In this case, a flange 496 extending along the upper edge 74 of the plate member 70 and having laterally spaced slots 498 therein may be employed to present the support surface 86 as shown in FIG. 18. In this case, only one interface angle 82 is required. If the foundation post 50 comprises plate members 170 secured to both flanges 56, flanges 496 may be employed with each plate member obviating the need for the interface angles. Each flange 496 may be in the form of a rectangular plate welded to the respective plate member or may be formed by folding an upper portion of the plate member downwardly. Alternatively, a plate that presents a continuous upper support surface may be affixed to the upper end of the elongate beam member 52.

In the embodiments described above, the upright posts 22 and foundation posts 50 may each comprise an elongate beam member in the form of an H-beam or an I-beam formed of steel or other suitable structural material. Those of skill in the art will appreciate that alternative elongate beam members may be employed. For example, the elongate beam members may be in the form of T-sections comprising a web, and a flange extending along an edge of the web, and arranged generally at a right angle to the web or may be in the form of C-sections. The elongate beam members may also be in the form of hollow sections generally resembling H-beams or I-beams and formed of plastic material, such as PVC etc.

In the embodiments described above, because the support posts are multi-component, different options in support post configuration may be available. Instead of employing foundation and upright posts that are of the same configuration, the foundation and upright posts may have different configurations (i.e. different dimensions, lengths and/or cross-sections). For example, depending on the height of the sound wall, the foundation posts 50 may be shorter than the upright posts 22 and/or the foundation and upright posts may have different cross-sectional shapes. For example, the foundation posts 50 may be in the form of hollow tubes with one or more plate members affixed thereto and the upright posts 22 may have a T-, H-, I- or C-cross-section.

In the embodiments described above, the support posts for the sound wall 20 are described and shown as being multi-part. In some embodiments, the foundation posts 50 and upright posts 22 may be integrally formed and of unitary construction and defined by continuous posts. In this case, each continuous post has a lower portion carrying one or more plate members that may be driven into the ground G and an upper portion that extends above the ground G and accommodates the ends of the elongate panels 24.

In some embodiments, a base plate may be coupled to a foundation post to define a support surface for securing a post positioned above a grade. To illustrate, reference is made to FIG. 19, which illustrates a foundation post 1900, in accordance with another embodiment of the present application. The foundation post 1900 may be similar to the foundation post illustrated in FIG. 10.

Figure 19:
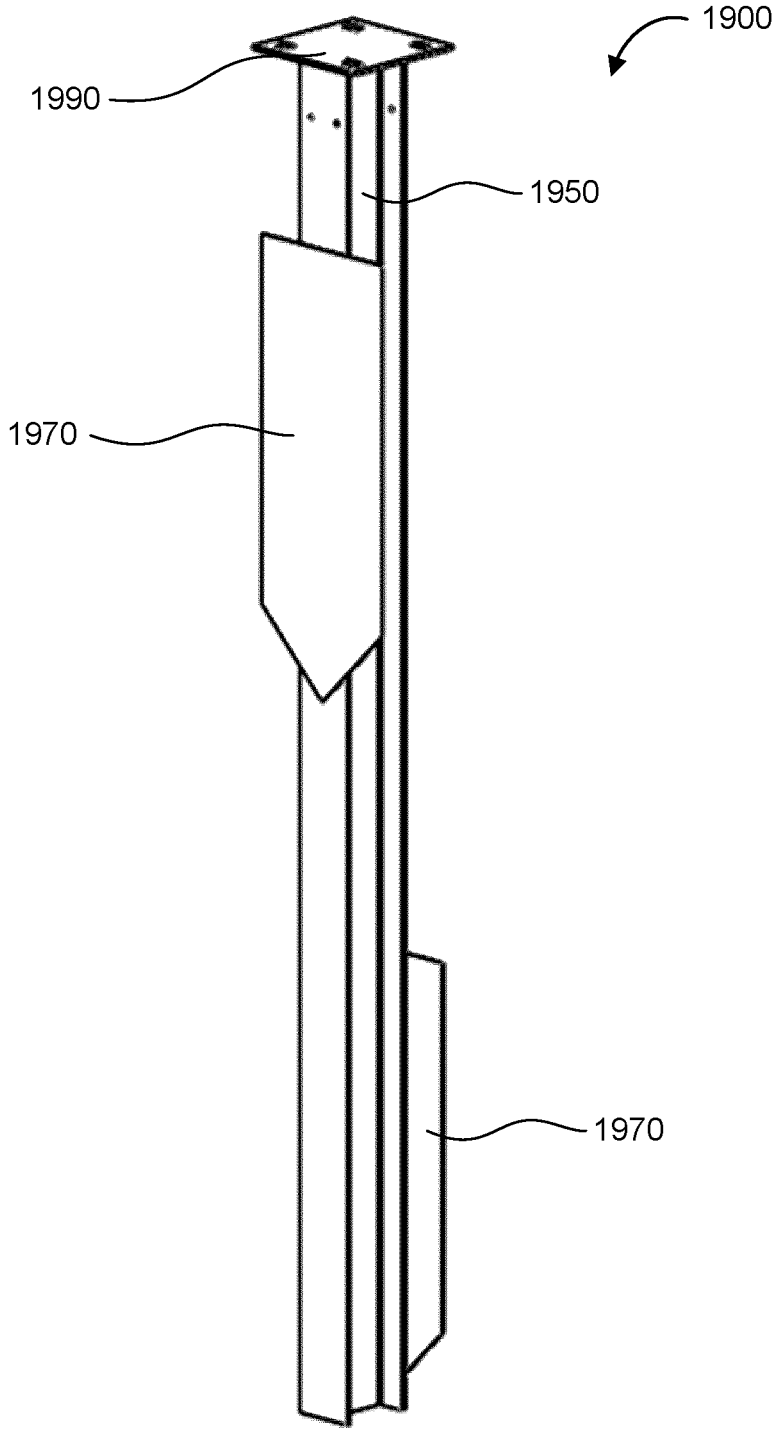
FIG. 19 is a perspective view of a foundation post, in accordance with an embodiment of the present application.

The foundation post 1900 may include an elongate beam 1950 and one or more plate members 1970 affixed to the elongate beam 1950. In the illustration of FIG. 19, the elongate beam 1950 may be an I-beam or an H-beam. The foundation post 1900 may include plate members 1970 affixed to opposing flanges of the elongate beam 1950 (e.g., opposing flanges of an I-beam or H-beam). In some embodiments, the two or more plate members 1970 may be staggered on opposing flanges of the elongate beam 1950. The plate members 1970 may be staggered in a longitudinal direction of the elongate beam 1950.

In some embodiments, the foundation post 1900 may include a base plate 1990 coupled to a top end of the elongate beam 1950. The top end of the elongate beam 1950 may be an end of the elongate beam 1950 that is nearer to a grade (e.g., surface of ground) when the foundation post 1900 may be installed in the ground. In some embodiments, the base plate 1990 may include one or more apertures defining a fastening mechanism for receiving or securing an elongate post above the grade.

Figure 20:
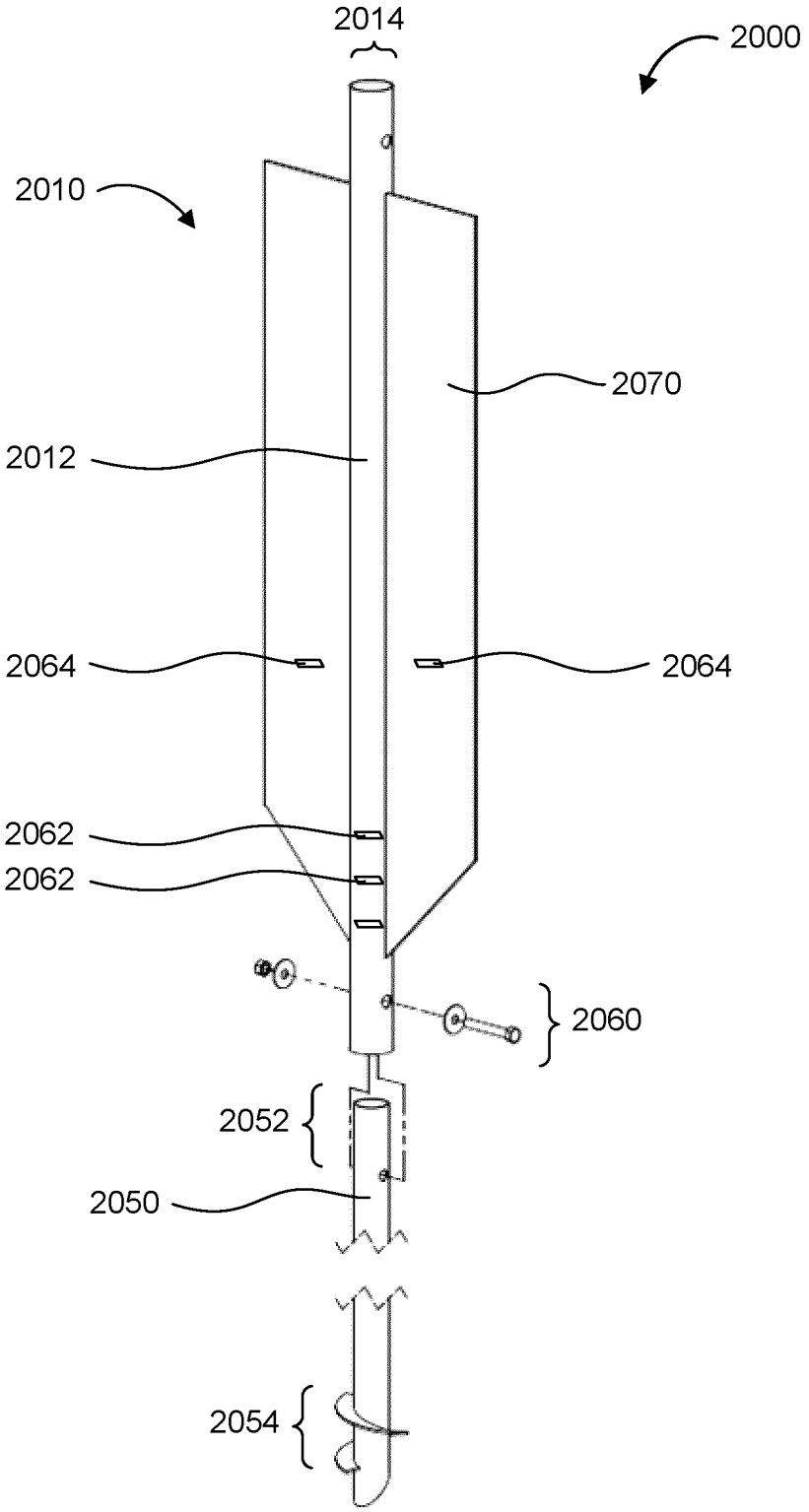
FIG. 20 is a foundation post, in accordance with another embodiment of the present application.

Reference is made to FIG. 20, which illustrates a foundation post 2000, in accordance with another embodiment of the present application. The foundation post 2000 includes a helical pile 2050 (or alternatively referred to as a screw pile) and a stabilizer member 2010.

The helical pile 2050 includes an attachment portion 2052 and a helix portion 2054. In some embodiments, the attachment portion 2052 may include a snap-fit member for coupling the helical pile 2050 to the stabilizer member 2010 described herein.

In some embodiments, the attachment portion 2052 may include an aperture or threaded hole for receiving a bolt or a pin for coupling the helical pile 2050 to the stabilizer member 2010.

The helix portion 2054 of the helical pile 2050 may configure the helical pile 2050 to be rotationally driven into earth or a substrate. In some embodiments, the helical pile 2050 may be rotationally driven or screwed into the substrate to a target depth prior to the stabilizer member 2010 being pushed into the substrate and prior to the stabilizer member 2010 being coupled to the helical pile 2050.

The stabilizer member 2010 includes an elongate member 2012. The elongate member 2012 may be a cylindrical post, a rectangular post, or the like, or a combination of two or more of the foregoing. The elongate member 2012 may include a coupling end 2060 for coupling with the attachment portion 2052 of the helical pile 2050. In the example illustrated in FIG. 20, the coupling end 2060 may include a through-hole aperture to receive a pin or bolt and nut combination for securing the coupling end 2060 to the attachment portion 2052.

The stabilizer member 2010 may include a plate member 2070 affixed to and/or extending from the elongate member 2012. The plate member 2070 may be dimensioned to extend beyond a lateral width 2014 of the elongate member 2012. When the stabilizer member 2010 is driven into the substrate such that at least a portion of the plate member 2070 is below grade of the substrate, the plate member 2070 may resist forces imparted on the foundation post 2000, for example by lateral wind loads on components above the grade that are coupled to the foundation post 2000.

Because the plate member 2070 may be dimensioned to extend beyond a lateral width 2014 of the elongate member 2012, a larger width or larger diameter elongate member 2012 that otherwise would be necessary to resist forces directly or indirectly imparted on the foundation post 2000 may not be necessary. Further, because the plate member 2070 may be dimensioned to extend beyond the lateral width 2014 of the elongate member 2012, the combination of the helical pile 2050 and the stabilizer member 2010 need not be driven to as large a depth that otherwise would be necessary to resist forces directly or indirectly imparted on the foundation post 2000. By reducing the necessary depth at which the foundation post 2000 may need to be driven to resist a given amount of force imparted on the foundation post 2000 (e.g., as compared to a foundation post 2000 not having a plate member 2070 affixed thereto), the example foundation posts described herein may be utilized in substrates where sub-grade rock or other sub-grade obstacles may be encountered.

In some embodiments, the stabilizer member 2010 may be a unitary body including the plate member 2070 and the elongate member 2012. In some other embodiments, the plate member 2070 and the elongate member 2012 may not be produced as a unitary body, but the plate member 2070 may be affixed to a surface of the elongate member 2012. In some embodiments, the elongate member 2012 may be an engagement member for engaging the helical pile 2050.

In some embodiments, the helical pile 2050 may be configured to be rotationally driven into the substrate (e.g., earth or ground). For example, the helical pile 1950 may be driven into the substrate from an initial substrate position to below the grade of the substrate in a longitudinal direction. The longitudinal direction may be substantially parallel to the length of the elongate member 2012.

Once the helical pile 2050 is rotationally driven to a target depth, the stabilizer member 2010 may be configured to be translationally driven or vibrated into the substrate to couple to the attachment portion 2052 of the helical pile 2050. For example, a coupling end 2060 of the elongate member 2012 may be positioned at the aforementioned initial substrate position, the stabilizer member 2010 may be driven (or otherwise pushed) into the substrate in the longitudinal direction until the coupling end 2016 abuts or mates with the attachment portion 2052 of the helical pile 2050. In some embodiments, the stabilizer member 2010 may be driven into the substrate using a vibratory pile driver, impact pile driver, or other suitable equipment. Accordingly, once the stabilizer member 2010 is driven into the substrate, at least a portion of the plate member 2070 may be below grade of the substrate and may resist forces imparted on the foundation post. In the present example, as the helical pile 2050 may be driven into the substrate prior to the stabilizer member 2010 being driven into the substrate, the helical pile 2050 and the stabilizer member 2010 may be separate, non-unitary components.

In some embodiments, the stabilizer member 2010 may be coupled to the attachment portion 2052 of the helical pile 2050 using at least one of a pin or a bolt-nut combination at the coupling end 2060, upon the stabilizer member 2010 being translationally driven into the substrate.

In some embodiments, the stabilizer member 2010 may interlock with the attachment portion 2052 of the helical pile 2050 by snap-fit connection (not illustrated in FIG. 20) upon the stabilizer member 2010 being translationally driven or vibrated into the substrate.

In some embodiments, the stabilizer member 2010 may include one or more uplift resist formations 2062 thereon. For example, the elongate member 2012 may include two or more longitudinally spaced uplift resist formations and may be configured to resist and withstand uplift adfreeze loads (i.e., frost heaving). In some examples, plate uplift resist formations 2064 may be included on the plate member 2070. Other placement configurations of the uplift resist formations may be contemplated.

In some embodiments, the uplift resist formations 2062 may be in the form of angled rectangular barbs that may be welded to the elongate member 2012 and/or the plate member 2070 and angled in an upward direction. As an example, the uplift resist formations may be angled upwardly at an angle of approximately 45 degrees. Other angular configurations may be contemplated. In some embodiments, the uplift resist formations may include tabs, holes, punch-outs, or the like, or a combination thereof.

In FIG. 20, when the stabilizer member 2010 (via the coupling end 2060) is coupled to the helical pile 2050 using a pin or bolt-nut combination, the stabilizer member 2010 may be driven to be below a grade (e.g., below ground) and it may be challenging for an installation technician to access and/or install a pin or bolt-nut combination at the interface between: (a) the coupling end 2060 of the stabilizer member 2010 and (b) the attachment portion 2052 of the helical pile 2050. Accessing the above-mentioned interface may require that the substrate surrounding the stabilizer member 2010 be removed or disturbed.

It may be desirable for providing embodiments to secure a stabilizer member to a helical pile based on coupling and/or fastening features nearer to a ground surface or a grade. To illustrate, reference is made to FIGS. 21A and 21B.

Figure 21B:
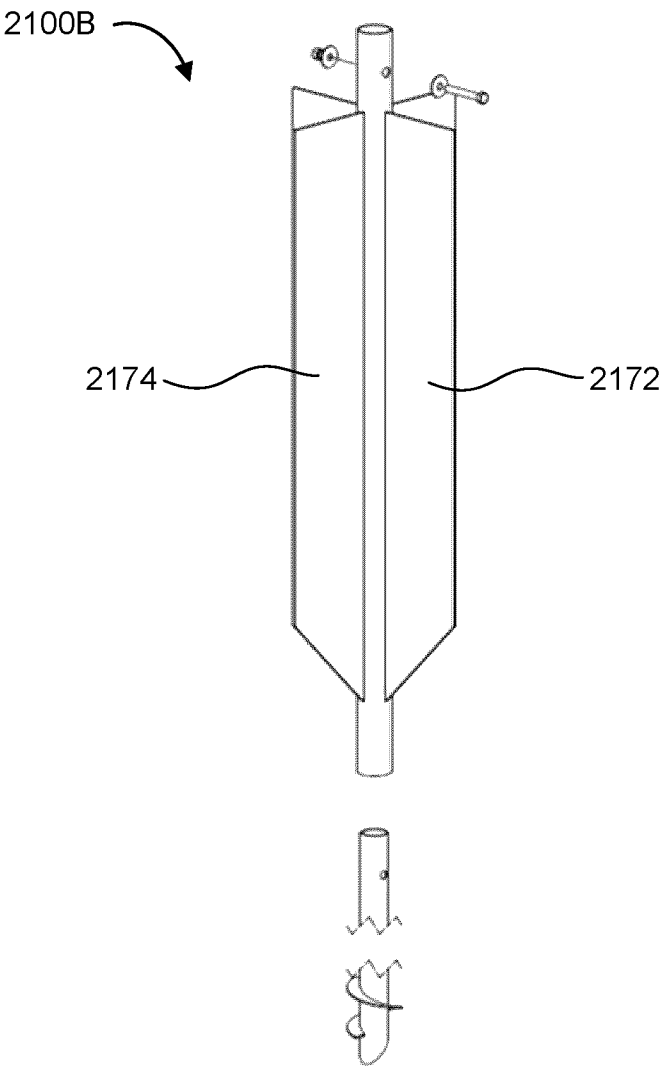
FIGS. 21A and 21B are perspective views of foundation posts, in accordance with embodiments of the present application.
Figure 21A:
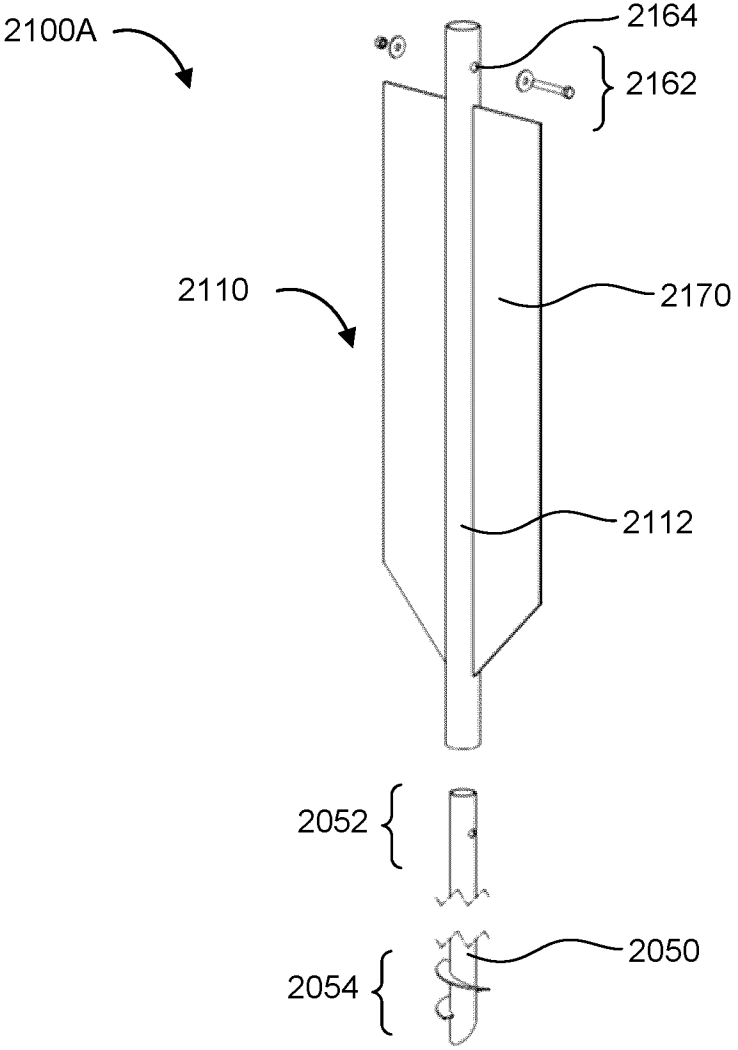

FIG. 21A illustrates a foundation post 2100A that may be similar to the foundation post of FIG. 2000. The foundation post 2100A may include the helical pile illustrated in FIG. 20. The helical pile 2050 may include the attachment portion 2052 and the helix portion 2054. The attachment portion 2052 may include a through-hole a for receiving a pin or bolt-nut combination.

The foundation post 2100A may include a stabilizer member 2110, and the stabilizer member 2110 may include an elongate member 2112. In FIG. 21A, the elongate member 2112 may be a cylindrical post. The stabilizer member 2110 may include a plate member 2170 affixed to the elongate member 2112. Similar to the stabilizer member illustrated in FIG. 20, the plate member 2170 may be positioned and/or dimensioned to extend beyond a lateral width of the elongate member 2112. In some embodiments, the elongate member 2112 may be an engagement member for engaging with the helical pile 2050.

Further, the stabilizer member 2110 may include an interconnecting aperture 2164. The interconnecting aperture 2164 may be configured as a through-hole aperture for receiving a pin or bolt-nut combination 2162. In FIG. 21A, the interconnecting aperture 2164 may be positioned on the elongate member 2112 such that when the stabilizer member 2110 is driven into the substrate (e.g., ground), the interconnecting aperture 2164 may be: (a) proximal to the grade level; and/or (2) align with the through-hole aperture of the attachment portion 2052 for receiving the pin or bolt-nut combination 2162. Accordingly, in the example illustrated in FIG. 21A, alignment of the interconnecting aperture 2164 with the through-hole (at the attachment portion 2052) of the helical pile 2050 may be accessible at a position proximal to the grade level.

As compared to the embodiment illustrated in FIG. 20, being able to access the interconnecting aperture 2164 near the grade (e.g., proximal to the surface of the ground substrate) may facilitate coupling of the stabilizer member 2110 to the helical pile 2050 without invasive disturbance of the ground substrate at depths below the plate member 2170.

In embodiments illustrated in FIG. 20 and FIG. 21A, the respective plate members may be oriented in a single plane. That is, the respective plate members may be configured to resist forces imparted on the foundation posts incident on a plane (e.g., the plane of the respective plate members). Thus, the example plate members may be configured to resist forces imparted in some directions but not resist forces, for example, imparted in a direction parallel to the plane of the plate member. It may be desirable to configure foundation posts to resist forces imparted on the foundation posts originating from a greater variety of directions. To illustrate other embodiments, reference is made to FIG. 21B.

FIG. 21B illustrates a foundation post 2100B that may be similar to the foundation post 2100A illustrated in FIG. 21A. In FIG. 21B, the foundation post 2100B includes an alternate plate member arrangement, in accordance with an embodiment of the present application.

The foundation post 2100B may include two or more plate member portions oriented in three-dimensional space. For example, the foundation post 2100B may include a first plate member portion 2172 and a second plate member portion 2174. The first plate member portion 2172 may lie in a plane that is different than a plane of the second plate member portion 2174, such that the plate members may resist forces that are imparted on the foundation post and originating from a greater variety of directions. For example, the first plate member portion 2172 may be oriented to be substantially perpendicular to the second plate member portion 2174. Other orientations of plate member portions may be contemplated. By positioning two or more plate members in different planes, the foundation post 2100B may be configured to resist forces imparted on the foundation post 2100B that originate from a wider variety of directions.

In FIGS. 20, 21A, and 21B, the embodiments of the foundation posts are illustrated as including a helical pile (e.g., helical pile 2050 in FIG. 20). In some other embodiments of the foundation posts, the foundation posts may include a cylindrical pile (e.g., non-helical pile), where the cylindrical pile may not include features for screwing the pile into the ground substrate. In some examples, the cylindrical pile may be driven or vibrated into the ground substrate using a pile driver apparatus.

Figure 22:
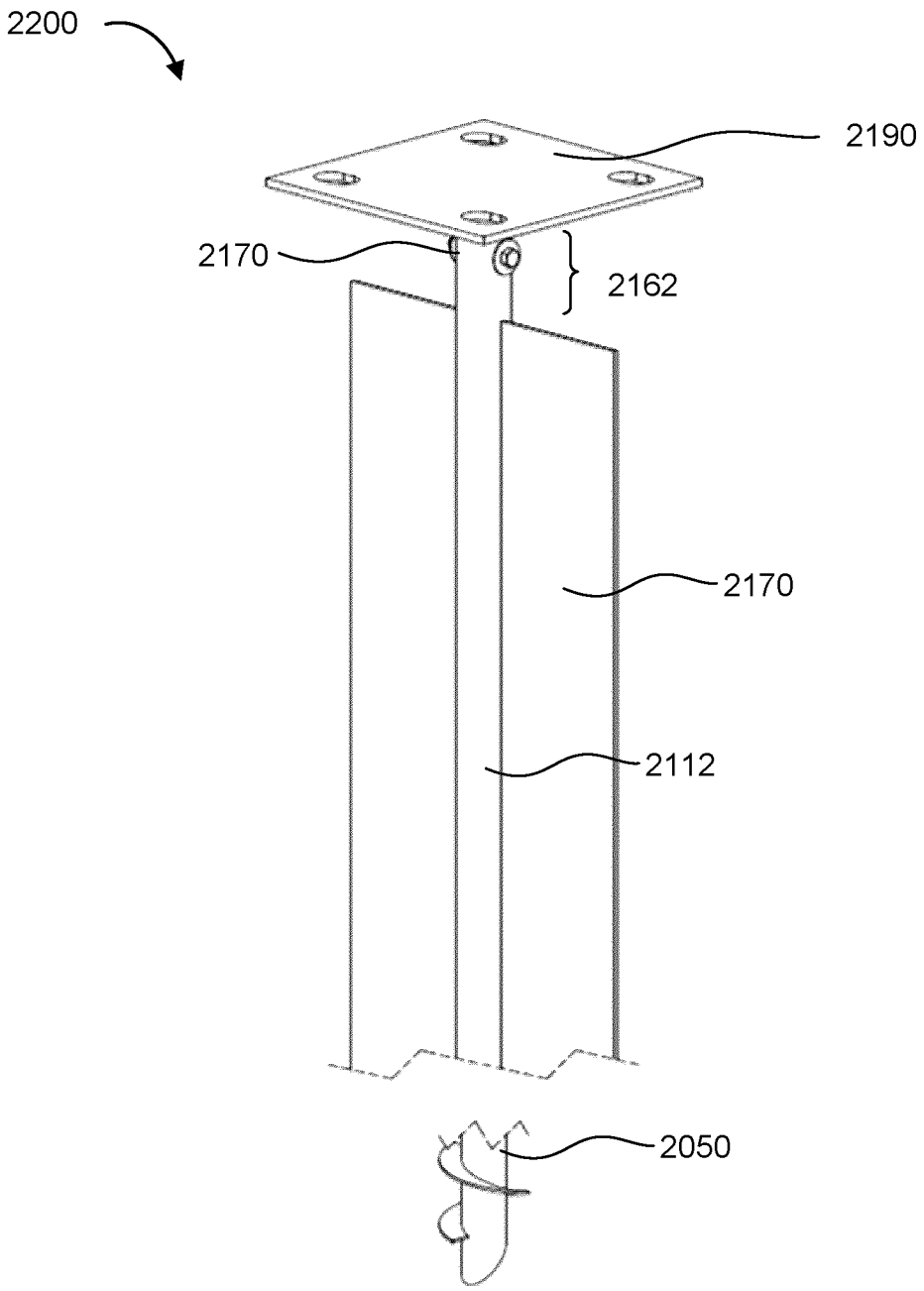
FIG. 22 is an enlarged partial view of a foundation post, in accordance with an embodiment of the present application.

Reference is made to FIG. 22, which illustrates an enlarged partial view of a foundation post 2200, in accordance with an embodiment of the present application. The foundation post 2200 may be similar to the foundation post 2100A illustrated in FIG. 21A. For example, the foundation post 2200 may include a helical pile 2050 that may be coupled to a stabilizer member. The stabilizer member may include one or more plate members 2170 affixed to an elongate member 2112.

When at least a portion of the helical pile 2050 may be received within the elongate member 2112 of the stabilizer member, an aperture in the helical pile 2050 may align with an interconnecting aperture 2154 for receiving the pin or bolt-nut combination 2162. When the pin or bolt-nut combination 2162 is inserted in the aligned apertures, the stabilizer member may be secured to the helical pile 2050.

Further, the foundation post 2200 may include a base plate 2190 coupled to the stabilizer member, and the base plate 2190 may be configured to support and/or secure an elongate post above the grade. For example, the base plate 2190 may include a surface having one or more apertures configured to receive and secure a sound wall post above ground.

In embodiments of the present application, foundation posts may include H-beams, !-beams, helical piles, screw piles, or the like. H-beams or I-beams may be vibrated or driven into a ground substrate (e.g., soil, rock, etc.). Helical piles or screw piles may be rotationally driven into the ground substrate. When driving a foundation post into the ground substrate, it may be desirable to minimize disturbance of the ground substrate surrounding the foundation post.

Further, it may be desirable to dynamically select and/or configure the support plates to be affixed to a foundation post based on anticipated lateral loads to be imparted on the foundation posts. Embodiments of the present application may include features for coupling a support plate to the foundation post such that disturbance by the support plate when the foundation post is driven into the ground substrate may be reduced. Further, embodiments of the present application may include features to configure a support plate to the foundation post ex post facto.

Accordingly, in some embodiments, a lateral support device may be provided for stabilizing an elongate foundation post installed in a substrate. In some embodiments, the substrate may be soil, earth, concrete, snow, ice, or other medium. The lateral support device may include an engagement member for engaging the elongate foundation post. The lateral support device may also include a support plate extending from the at least one engagement member. The support plate may have a plate width greater than a post width of the elongate foundation post. The support plate may be slidable relative to the foundation post in an elongate direction when the engagement member engages a portion of the elongate foundation post. When the engagement member is in an engaged position, at least a portion of the support plate is below the grade of the substrate.

Figure 23:
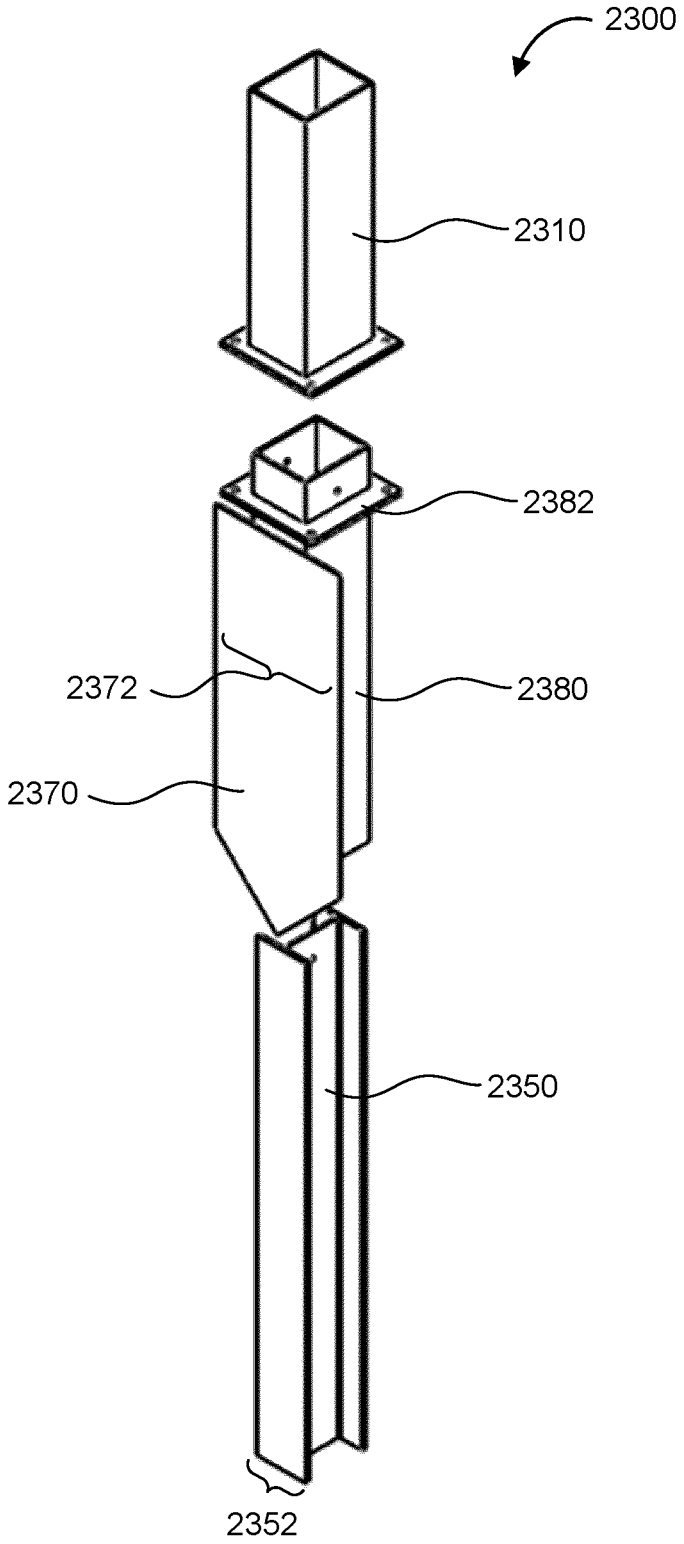
FIG. 23 is a partially exploded perspective view of a foundation post, in accordance with an embodiment of the present application.

To illustrate, reference is made to FIG. 23, which illustrates a partially exploded perspective view of a foundation post 2300, in accordance with an embodiment of the present application.

The foundation post assembly 2300 may include an elongate foundation post 2350 configured to be vibrated or driven into a ground substrate. The foundation post 2350 may extend in a longitudinal direction. In FIG. 23, the foundation post 2350 may be an I-beam or an H-beam.

The foundation post assembly 2300 may include a support plate 2370 having a transverse dimension 2372 in a transverse direction greater than a post width 2352 of the foundation post 2350. That is, the support plate 2370 may extend beyond opposing sides of the foundation post 2350. For example, the plate width may be greater than a post width of the elongate foundation post. In some embodiments, the transverse direction may be substantially normal to the longitudinal direction.

In the illustrated example, the post width 2352 may be a width of a flange of the I-beam or the H-beam. When the support plate 2370 may be driven to below grade of the ground substrate, the support plate 2370 may resist forces imparted on the foundation post assembly 2300. In some scenarios, the support plate 2370 may resist lateral wind loads on components, such as a sound wall, supported by the foundation post assembly 2300.

The foundation post assembly 2300 may include an engagement member for engaging at least a portion of the elongate foundation post. In FIG. 23, the engagement member may include a frame 2380 affixed to the support plate 2370. The frame 2380 may define a hollow steel section to encircle at least a portion of the foundation post 2350. In some scenarios, the support plate 2370 and the frame 2380 (affixed to the support plate 2370) may in combination be a support assembly that may be inserted over a portion of the foundation post 2350. In some scenarios, subsequent to the foundation post 2350 being driven or vibrated into the ground substrate, the support assembly may be pushed into the ground substrate and over a portion of the foundation post 2350. In some embodiments, the frame 2380 may be an engagement member for engaging with the foundation post 2350.

In some embodiments, the support assembly may include a base plate 2382 integrated with the frame 2380. The base plate 2382 may be configured to support and/or retain a support post 2310. The support post 2310 may be hollow steel post, an H-beam/I-beam, or other elongate structure configured above the grade or ground substrate. In FIG. 23, the base plate 2382 may include a rectilinear protrusion extending away from the frame 2380 and that may be received by the support post 2310. In FIG. 23, the rectilinear protrusion may be received within a hollow steel post (e.g., the support post 2310). In some embodiments, the support post 2310 may be in a series of support posts for supporting sound wall panels, described herein. Other structures to be retained or supported by the support post 2310 may be contemplated.

Figure 24:
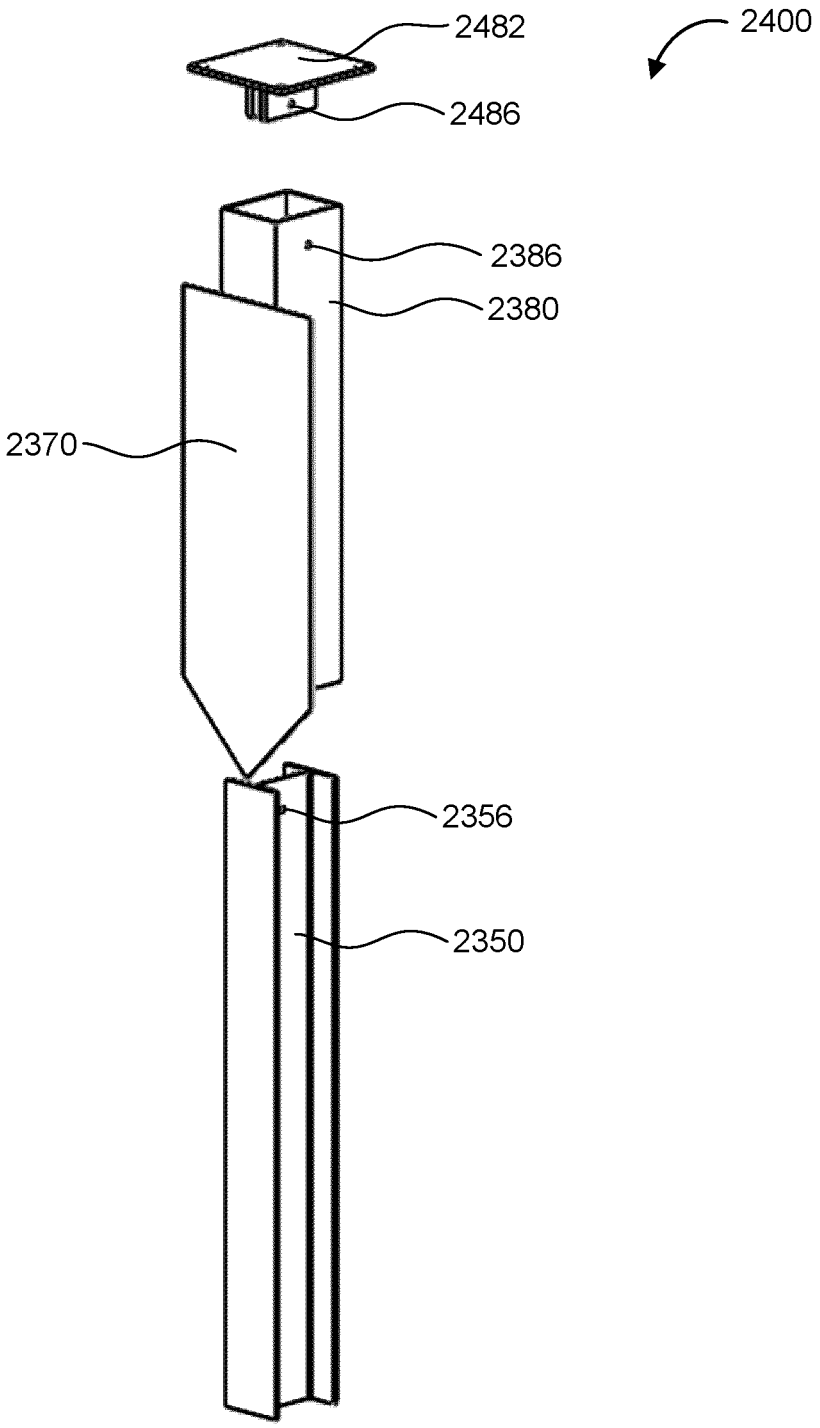
FIG. 24 is a partially exploded perspective view of a foundation post assembly, in accordance with an embodiment of the present application.

Reference is made to FIG. 24, which illustrates a partially exploded perspective view of a foundation post assembly 2400, in accordance with another embodiment of the present application. The foundation post assembly 2400 may be similar to the foundation post assembly 2300 illustrated in FIG. 23. For example, the foundation post assembly 2400 may include the foundation post 2350, a support plate 2370 having a transverse dimension in a traverse direction greater than a post width of the foundation post 2350.

The foundation post assembly 2400 may include the frame 2380 affixed to the support plate 2370 defining features to encircle at least a portion of the foundation post 2350. The combination of the frame 2380 and the support plate 2370 may be the support assembly for positioning over a portion of the foundation post 2350. In some embodiments, the frame 2380 may be an engagement member for engaging the foundation post 2350.

Further, the foundation post assembly 2400 may include a weldment 2482 having a substantially planar support surface. For example, the weldment 2482 may be a base plate that includes features to be received within the frame 2380. In the present example, upon the foundation post 2350 being vibrated into the ground substrate, the support plate 2370 may be coupled to the foundation post 2350 via the frame 2380. Further, the weldment 2482 may be fitted to the frame 2380 such that a post or foundation aperture 2356 (positioned on a web of with the foundation post 2350), a member or frame aperture 2386 (positioned proximal to an end of the frame 2380), and a base aperture 2486 align. When the foundation aperture 2356, the frame aperture 2386, and the base aperture 2486 may be aligned, a fastener may be received within the aligned apertures to secure the weldment 2482 to the combination of the foundation post 2350 and the frame 2380.

In some embodiments, a pin or nut-bolt combination may be received within the aligned apertures for securing the support plate 2370 to the foundation post 2350. Further, the pin or nut-bolt combination may secure the components of the foundation post assembly 2400. By securing the support plate 2370 to the foundation post 2350, movement of the support plate 2370 relative to the foundation post 2350 (e.g., due to frost heaving, ground substrate shifting or movement, etc.) may be reduced. Further, as the support plate 2370 may be secured to the foundation post 2350 at a position proximal to a grade or ground surface, disturbance of the ground substrate during installation of the support plate 2370 may be reduced.

Figure 25B:
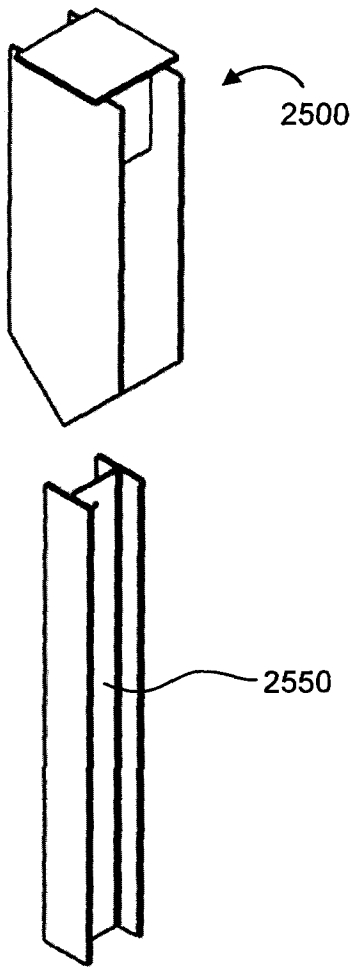
FIGS. 25A and 25B is a side elevation view of a support assembly and a perspective view of a support assembly/foundation post, respectively, in accordance with an embodiment of the present application.
Figure 25A:
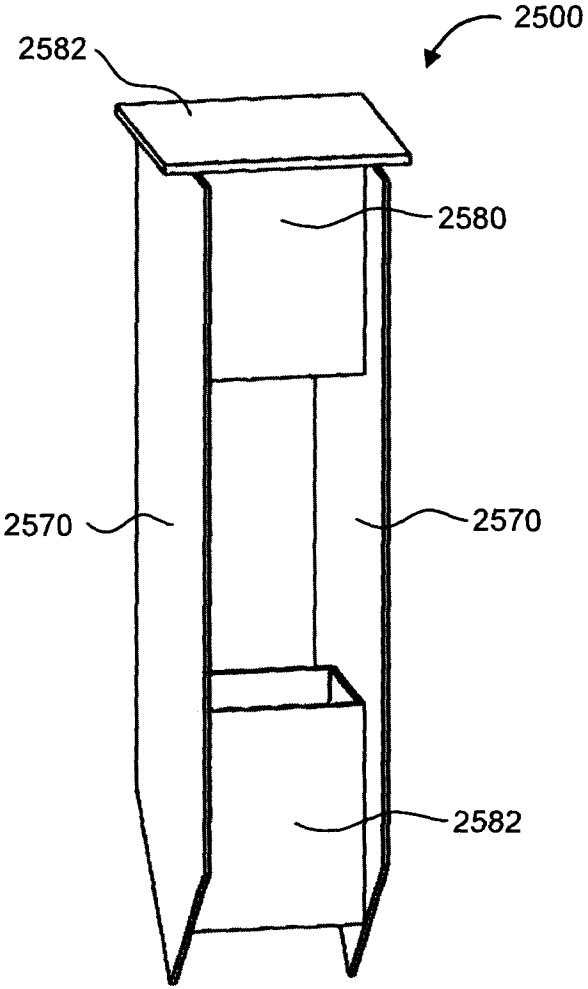

Reference is made to FIG. 25A, which illustrates a side elevation view of a support assembly 2500, in accordance with another embodiment of the present application. The support assembly 2500 may include a pair of support plates 2570. The support plates 2570 may be configured to have a transverse dimension in a transverse direction greater than a post width of a foundation post on which the support assembly 2500 may be installed.

The pair of support plates 2570 may respectively be affixed to a frame 2580. The frame 2580 may define a structure to encircle at least a portion of a foundation post on which the support assembly 2500 may be installed. In FIG. 25A, the frame 2580 may be a hollow steel section. The frame 2580 may be constructed of other material other than steel. In some embodiments, the support assembly 2500 may include one or more additional frames 2582 for providing support and/or structure in an elongate direction of one or more of the pair of support plates 2570. In some embodiments, the frame 2580 may be an engagement member for engaging a foundation post on which the support assembly 2500 may be installed.

The support assembly 2500 may include a weldment 2582 providing a substantially planar support surface for supporting a post above a grade of the ground substrate. In some embodiments, the weldment 2582 may include one or more apertures (not explicitly illustrated in FIG. 25A) for receiving fasteners for securing a support post to the support assembly 2500.

FIG. 25B illustrates a perspective view of the support assembly 2500 of FIG. 25A and a foundation post 2550 on which the support assembly 2500 may be installed. In FIG. 25B, the foundation post 2550 may be an H-beam or an I-beam. In some other embodiments, the foundation post 2550 may be a rectilinear post, a cylindrical post, or a post having other geometric shape or configuration on which the frame 2580 of the support assembly 2500 may mate.

As described in the present application, it may be desirable to dynamically select and/or configure support plates to be affixed to a foundation post based on anticipated lateral loads, ground substrate material type, ground substrate material conditions, or other environmental factors. In some scenarios, it may be desirable to install a foundation post assembly, including a foundation post and a support plate coupled thereto, with reduced disturbance to the ground substrate. In some embodiments, a foundation post assembly may include a foundation post and a support plate configured to be adjustably coupled to the foundation post.

Figure 26B:
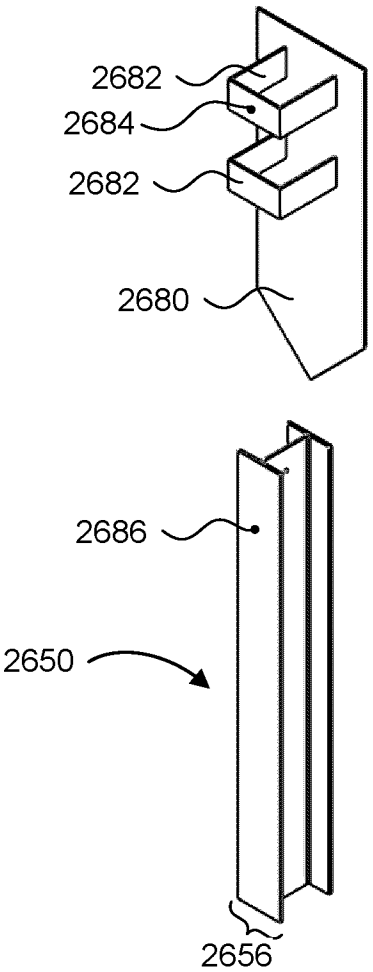
FIGS. 26A and 26B are exploded perspective views of foundation post assemblies, in accordance with embodiments of the present application.
Figure 26A:
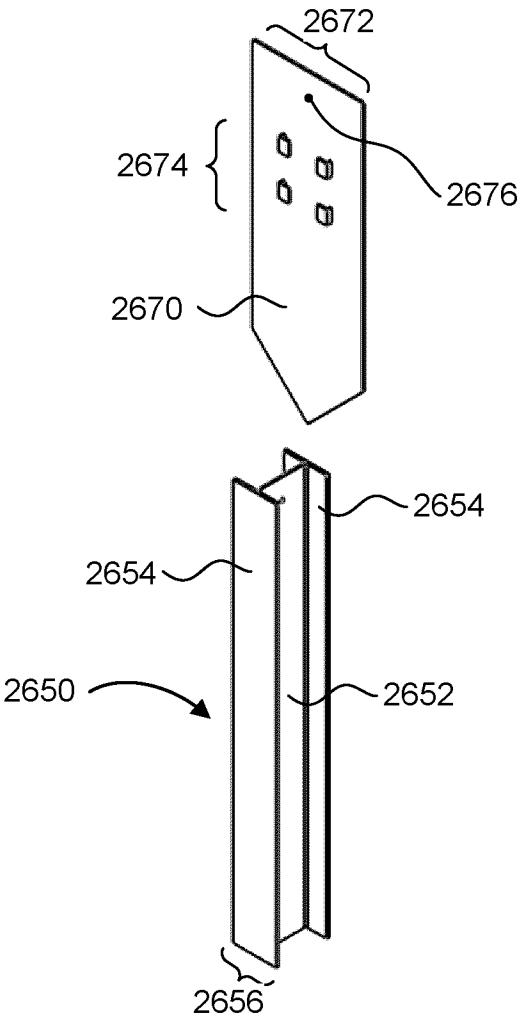

FIG. 26A illustrates an exploded perspective view of a foundation post assembly 2600A, in accordance with an embodiment of the present application. The foundation post assembly 2600A includes a foundation post 2650 and a support plate 2670 having a transverse dimension 2672 in a transverse direction greater than a post width 2656 of the foundation post 2650. In some embodiments, the foundation post 2650 may be an I-beam or an H-beam. The !-beam or H-beam may be constructed of a web 2652 and a flange 2654 on opposing sides of the web 2652.

The support plate 2670 may include one or more engagement members for engaging at least a portion of the elongate foundation post. The one or more engagement members may include one or more cantilevered protrusions 2674 protruding from a surface of the support plate 2670. The one or more cantilevered protrusions 2674 may engage at least a portion of the foundation post 2650, such as a flange 2654 of the foundation post 2650. For example, the one or more cantilevered protrusions 2674 may define features to interlock the support plate 2670 to the elongate foundation post.

In FIG. 26A, the one or more cantilevered protrusions 2674 may be L-shaped punch-outs that may be adapted to engage with one of the flanges 2654 of the foundation post 2650. For example, the one or more cantilevered protrusions 2674 may be configured to couple the support plate 2670 to the foundation post 2650 when the cantilevered protrusions 2674 may be lined up with one of the flanges 2654 of the foundation post 2650 and translationally slid into the flange 2654. In some embodiments, the one or more cantilevered protrusions 2674 may be L-shaped protrusions welded to the surface of the support plate 2670. In some embodiments, the one or more protrusions may be configured as other geometric shapes for encircling or interlocking with the flange of the elongate foundation post.

In some scenarios, the foundation post 2650 may be vibrated or driven into a ground substrate at a desired position. When at least a portion of the foundation post 2650 is installed in the ground substrate, the one or more cantilevered protrusions 2674 may be lined up with the flange 2654 and the support plate 2670 may be pushed or translationally driven into the ground substrate to a desired depth. By coupling the support plate 2670 to the foundation post 2650 after the fact, dimensions or features of the support plate 2670 may be selected based on anticipated lateral loads to be imparted on the foundation post, ground substrate composition, ground substrate conditions, or other environmental conditions determined at an installation site. As the support plate 2670 may not be fixed to the foundation post 2650 prior to installation in the ground substrate, support plates 2670 may be transported to an installation site separately from foundation posts 2650 to allow transportation efficiencies (e.g., as support plates may be dimensioned to have transverse dimensions greater than foundation post widths, foundation posts may be more efficiently stacked when not coupled to support plates).

In some embodiments, the cantilevered protrusions 2674 may be dimensioned to allow the support plate 2670 to slide along the flange 2654 of the foundation post 2650. Thus, in some scenarios, the support plate 2670 may (1) be coupled, via the cantilevered protrusions 2674, to the foundation post 2650; (2) be initially positioned at a target position below grade of the ground substrate; and (3) slide along the flange 2654 of the foundation post 2650 (while remaining at the target position below the grade of the ground substrate) as the foundation post 2650 may be vibrated or driven into the ground substrate. That is, the foundation post 2650 and the support plate 2670 may slide relative to one another as the foundation post 2650 may be vibrated or driven into the ground substrate. Because the support plate 2670 remains at the target position whilst the foundation post 2650 is vibrated or driven to a desired depth in the ground substrate, disturbance of the ground substrate at an elevation below the target position (of the support plate 2670) may be reduced.

In some embodiments, the support plate 2670 may include a plate fastening aperture 2676. The plate fastening aperture 2676 may receive a fastener for fastening the support plate 2670 to the foundation post 2650. By fastening the support plate 2670 to the foundation post 2650 upon coupling the support plate 2670 to the foundation post 2650, the position of the support plate 2670 relative to the foundation post 2650 may not change, preventing movement of the support plate 2670 from frost heave, shifting ground substrate, or other forces that may cause the position of the support plate 2670 to change relative to the foundation post 2650.

In some embodiments, the support plate 2670 of FIG. 26A may be configured to engage various elongate foundation posts, such as the elongate foundation post 1950 illustrated in FIG. 19. Further, the support plate 2670 may be included in a series of support plates that may respectively be positioned at different or various positions along the elongate foundation post 1950. In some embodiments, the series of support plates positioned at various positions along the elongate foundation post 1950 may be positioned in different planes. In some embodiments, the planes may be substantially normal to one another, or at any other angle relative to one another.

It may be appreciated that embodiments of the support plate described in the present application may be included in a series of support plates respectively engaging with a foundation post at: (a) different or various positions along the foundation post; and/or (b) positioned in different planes relative to one another.

FIG. 26B illustrates an exploded perspective view of a foundation post assembly 2600B, in accordance with an embodiment of the present application. In FIG. 26B, the foundation post assembly 2600B may include a foundation post 2650 having features substantially similar to the foundation post illustrated in FIG. 26A. For example, the foundation post 2650 may be an I-beam or H-beam. In some other embodiments, the foundation post may be a cylindrical post, a rectilinear post, or a post having other geometric shape.

The foundation post assembly 2600B includes a support plate 2680 having one or more loops 2682 that may be welded or adhered to a surface of the support plate 2680. The one or more loops 2682 may be engagement members for engaging at least a portion of the elongate foundation post 2650. The one or more loops 2682 may define frames to encircle at least a portion of the foundation post 2650. In the example illustrated in FIG. 26A, the one or more loops 2682 may be rectilinear shaped loops and may be dimensioned to encircle the illustrated H-beam or I-beam. In some other embodiments, the one or more loops 2682 may be of other geometric shapes, such as a circular or elliptical shaped loop for encircling the illustrated H-beam or I-beam. For example, the one or more loops 2682 may encircle over the pair of flanges of the H-beam or I-beam. As the one or more loops 2682 may be dimensioned to allow the support plate 2680 to slide along the foundation post 2650 in a longitudinal direction (e.g., along the elongate dimension of the foundation post 2650), the support plate 2680 may be positioned at a target position in the ground substrate and remain in the target position as the foundation post 2650 may be driven or vibrated into the ground substrate.

In some embodiments, the support plate 2680 may include a plate fastening aperture 2684. The plate fastening aperture 2684 may receive a fastener for fastening the support plate 2670 to the foundation post 2650. In some embodiments, the foundation post 2650 may include a corresponding post aperture 2686. When the plate fastening aperture 2684 may be aligned with the corresponding post aperture 2686, a fastener may be received within the aligned apertures, such that the position of the support plate 2680 relative to the foundation post 2650 may not change. The aligned apertures and the fastener received within the aligned apertures may prevent movement of the support plate 2680 caused by frost heave, shifting ground substrate, or other forces that may cause the position of the support plate 2680 to change relative to the foundation post 2650.

Figure 27:
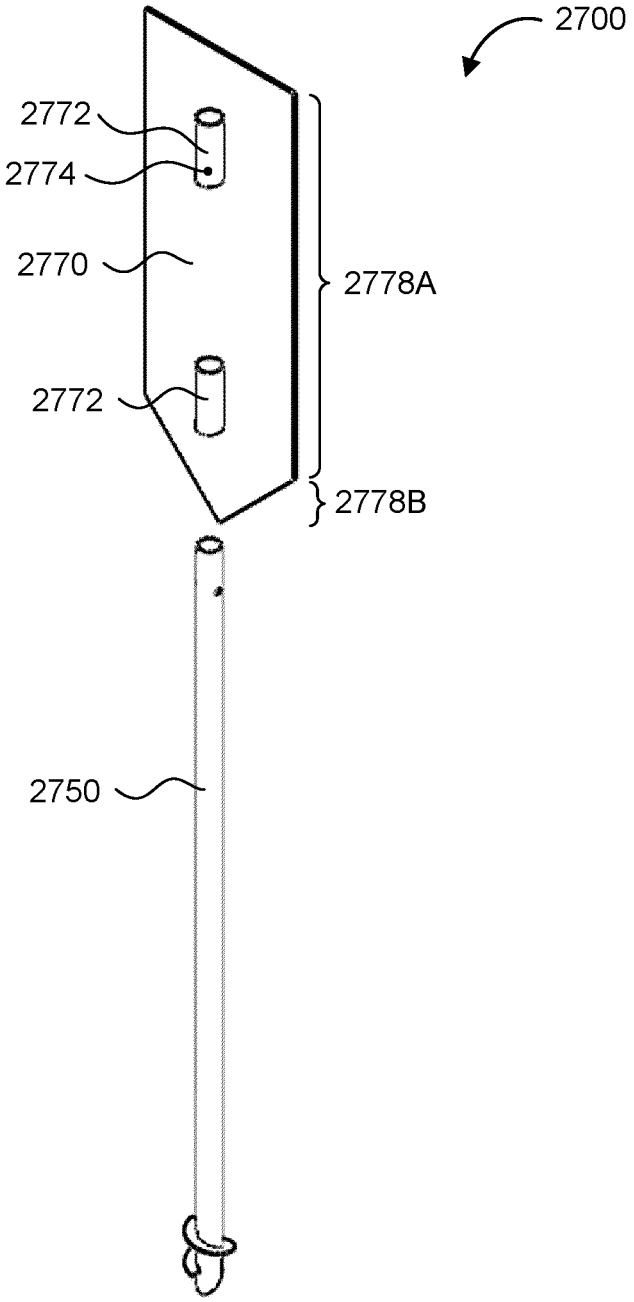
FIG. 27 illustrates an exploded perspective view of a foundation post assembly, in accordance with an embodiment of the present application.

Reference is made to FIG. 27, which illustrates an exploded perspective view of a foundation post assembly 2700, in accordance with an embodiment of the present application. The foundation post assembly 2700 may include a cylindrical pile 2750. In some embodiments, the cylindrical pile 2750 may be a helical pile or a screw pile.

The foundation post assembly 2700 includes a support plate 2770. The support plate 2770 may include a substantially rectangular-shaped portion 2778A and a triangular-shaped portion 2778B. The triangular-shaped portion 2778B may be dimensioned to allow the support plate 2770 to be more easily pushed into a ground substrate. Accordingly, the pointed tip of the support plate 2770 may be used to align with a desired entry point into the ground substrate and may be a leading edge when the support plate 2770 may be pushed into the ground substrate.

The support plate 2770 may include one or more loops 2772. The one or more loops 2772 may be engagement members for engaging at least a portion of the foundation post 2750. The one or more loops 2772 may be welded or adhered to a surface of the support plate 2770. The one or more loops 2772 may be substantially oval, circular, elliptical, or the like. The one or more loops 2772 may define a frame to encircle at least a portion of the foundation post 2750. In the example illustrated in FIG. 27, the one or more loops 2772 may be cylindrical shaped having a substantially circular cross section, and may be dimensioned to encircle the cylindrical pile 2750. Accordingly, the support plate 2770 may be coupled to the foundation post 2750, all while the support plate 2770 being slidable relative to movement of the foundation post 2750 (e.g., when the foundation post 2750 is driven into the ground substrate).

In some embodiments, the one or more loops 2772 may include a loop fastener 2774 for receiving a fastener to fasten the support plate 2770 to the foundation post 2750. The fastener may restrict movement of the support plate 2770 relative to the foundation post 2750 caused at least in part by shifting ground substrate, frost heave, or the like.

Embodiments of the present application may provide foundation post assemblies that may be installed into a ground substrate, whilst reducing the magnitude of disturbance of the ground substrate as compared to a foundation post having lateral plate features rigidly fixed to the foundation post. To illustrate features described in the present application, reference is made to FIGS. 28A, 28B, 29A, and 29B.

Figure 28B:
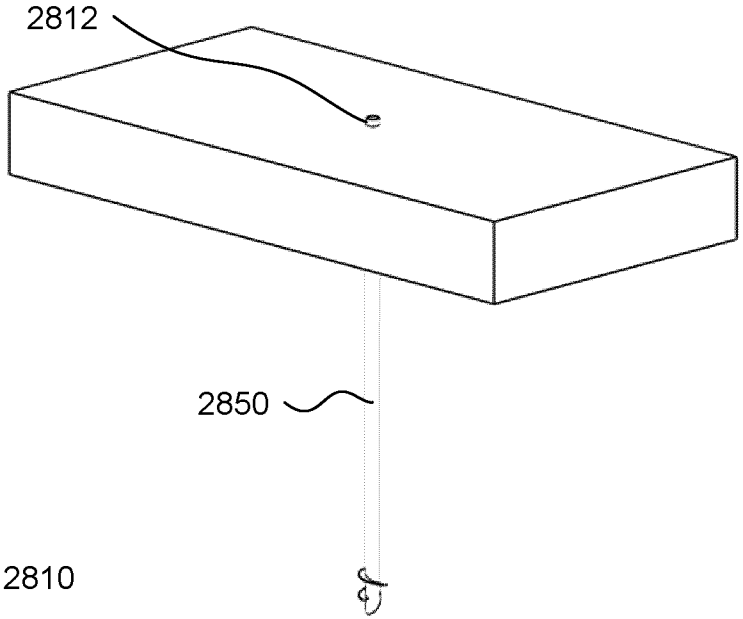
FIGS. 28A and 28B are partial perspective views of a ground substrate and a cylindrical pile to be installed in the ground substrate, in accordance with an embodiment of the present application.
Figure 28A:
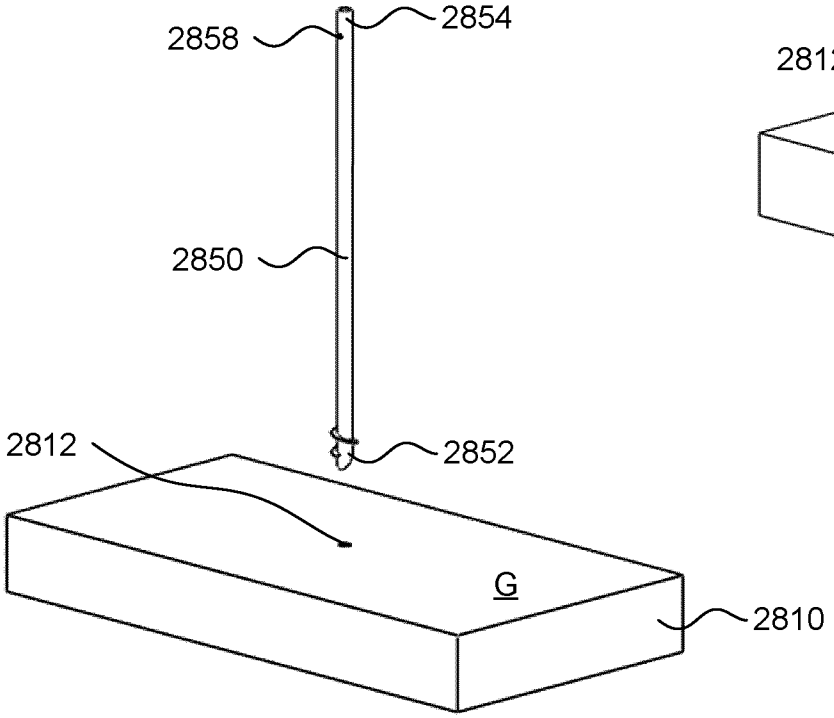

FIGS. 28A and 28B illustrate a partial perspective view of a ground substrate 2810 and a cylindrical pile 2850 to be installed in the ground substrate 2810, in accordance with an embodiment of the present application. The cylindrical pile 2850 may be a helical pile, a screw pile, or the like.

The ground substrate 2810 may be a grade of a ground surface in which the cylindrical pile 2850 (e.g., foundation post) may be installed. The cylindrical pile 2850 may be installed in the ground substrate and may be configured to support an above-ground support post (not illustrated in FIGS. 28A and 28B). As an example, the above-ground support post may be a support post in a series of posts for retaining a sound wall.

In FIG. 28A, the cylindrical pile 2850 may be a screw pile having an entry end 2852 with screw features. The cylindrical pile 2850 may be positioned proximal to a target entry position 2812 on the ground substrate 2810. In addition, the cylindrical pile 2850 may have a support end 2854. As will be described, the support end 2854 may be configured to support an above-ground support post. Further, the support end 2854 may include pile aperture 2858 for receiving a pin or nut-bolt combination and for securing a lateral support assembly thereto. In some embodiments, in addition to or in place of placing a pin or nut-bolt combination into the pile aperture 2858 for securing the lateral support assembly to the cylindrical pile 2850, other fasteners or affixers may be used. For example, the lateral support assembly may be welded to or adhered to (e.g., using glue or other adhesive) the cylindrical pile 2850.

In FIG. 28B, the cylindrical pile 2850 may be rotationally driven into the ground substrate 2810 to a desired depth. In FIG. 28B, the cylindrical pile 2850 does not include a lateral support assembly affixed thereto.

Figure 29B:
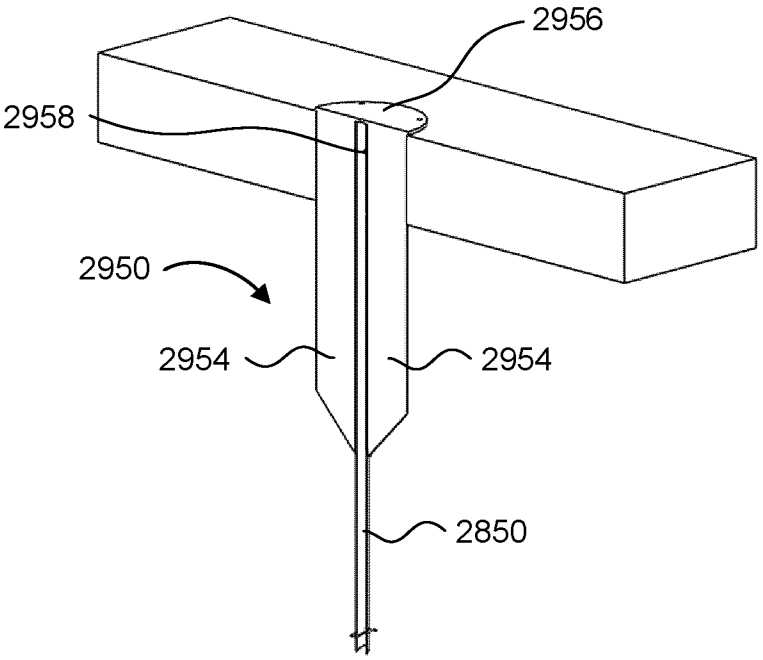
FIGS. 29A and 29B are partial perspective views of the ground substrate and features of a foundation post assembly being installed, in accordance with embodiments of the present application.
Figure 29A:
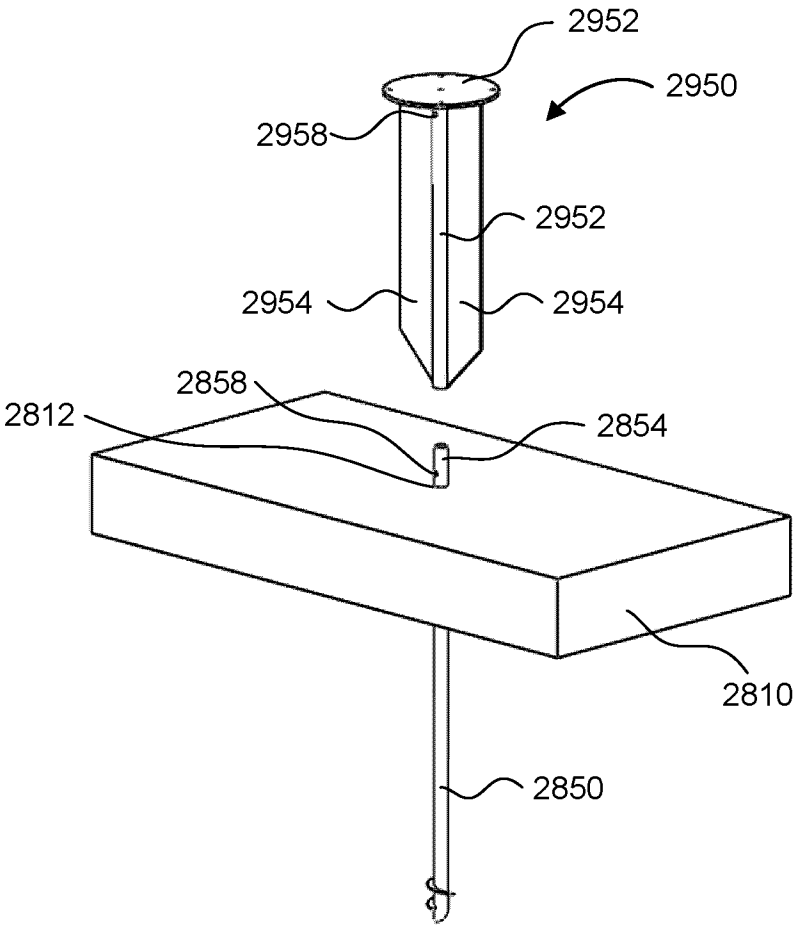

FIGS. 29A and 29B illustrate partial perspective views of the ground substrate 2810 and features of the foundation post assembly being installed, in accordance with embodiments of the present application. In FIG. 29A, the cylindrical pile 2850 may be positioned such that the support end 2854 is positioned above the grade. For example, the pile aperture 2858 may be above the grade of the ground substrate 2810.

Further, in FIG. 29A, a lateral support assembly 2950 may be positioned proximal to the target entry position 2812. The lateral support assembly 2950 may include an elongate member 2952 and one or more plate members 2954 affixed to the elongate member 2952. The one or more plate members 2954 may be dimensioned to extend beyond a lateral width of the elongate member 2952. The elongate member 2952 may include a support aperture 2958. As will be described, when the support aperture 2958 is aligned with the pile aperture 2858, a pin or screw-nut combination may be received therein for securing the lateral support assembly 2950 to the cylindrical pile 2850, such that movement of the lateral support assembly 2950 relative to the cylindrical pile 2850 may be reduced.

In some embodiments, the elongate member 2952 may be an engagement member for engaging the cylindrical pile 2850.

The lateral support assembly 2950 may include a weldment portion 2956 affixed to the elongate member 2852. When the lateral support assembly 2950 is installed, the weldment portion 2956 may provide a support surface to an above-grade support post. In FIG. 29A, the weldment portion 2956 may provide a circular or elliptical cross-sectional area for providing the support surface to an above-grade support post. Other geometric shapes for the support surface may be contemplated.

As the lateral support assembly 2950 may be aligned or positioned proximal to the target entry position 2812, the lateral support assembly 2950 may be translationally driven or pushed into the ground substrate 2810. A portion of the cylindrical pile 2850 may be received within the elongate member 2952. As such, the lateral support assembly 2950 may be coupled to the cylindrical pile 2850.

Further, in some embodiments, when the lateral support assembly 2950 is coupled to the cylindrical pile 2850, the pile aperture 2858 may align with the support aperture 2958 and a pin or screw-nut combination may be received within the aligned apertures to reduce movement of the lateral support assembly 2950 relative to the cylindrical pile 2850. In some embodiments, in addition to or in place of the pin or screw-nut combination, the lateral support assembly 2950 may be welded to or otherwise adhered to the cylindrical pile 2850. In some embodiments, welding or otherwise adhering may include stick welding, brazing, or the like.

As illustrated in FIG. 29A, the cylindrical pile 2950 may initially be rotationally driven into the ground substrate 2810 such that the support end 2854 and the pile aperture 2858 may be above the grade. That is, the elongate foundation post may be inserted until a grade end of the elongate foundation post is proximal to a grade of the ground substrate. Thus, in some scenarios, the pin or screw-nut combination may be inserted within the aligned pile aperture 2858/support aperture 2958 combination for securing the lateral support assembly 2950 to the cylindrical pile 2850. In some other scenarios, the pin or screw-nut combination may be inserted within the aligned pile aperture 2858/support aperture 2958 combination and, subsequently, the combined lateral support assembly 2950 and the cylindrical pile 2850 may be finally pushed into the ground substrate 2810. By initially having the support end 2854 above the grade whilst installing the lateral support assembly 2950, an installation technician may be able to insert the pin or screw-nut combination without substantially disturbing or moving material proximate to the target entry position.

Further, as the lateral support assembly 2950 may be aligned with the cylindrical pile 2850 and translationally vibrated, driven, or pushed into the ground substrate 2810, disruption of the ground substrate 2810 by the one or more plate members 2954 (e.g., one or more plate members pushing material of the ground substrate 2810) may be reduced, as compared to when plate members may, in part, be limited to move (e.g., plate members rigidly fixed to a cylindrical pile or prevented from sliding beyond a given position in an elongate direction of a cylindrical pile) and rotated about an axis of the cylindrical pile. Note that when the plate members are fixed or movement limited relative to the cylindrical pile and when said cylindrical pile is rotationally driven into the ground substrate, the plate members may rotationally move material in the ground substrate. Rotationally moving material in the ground substrate may disturb the ground substrate and alter structural integrity characteristics of otherwise undisturbed ground substrate.

Figure 30B:
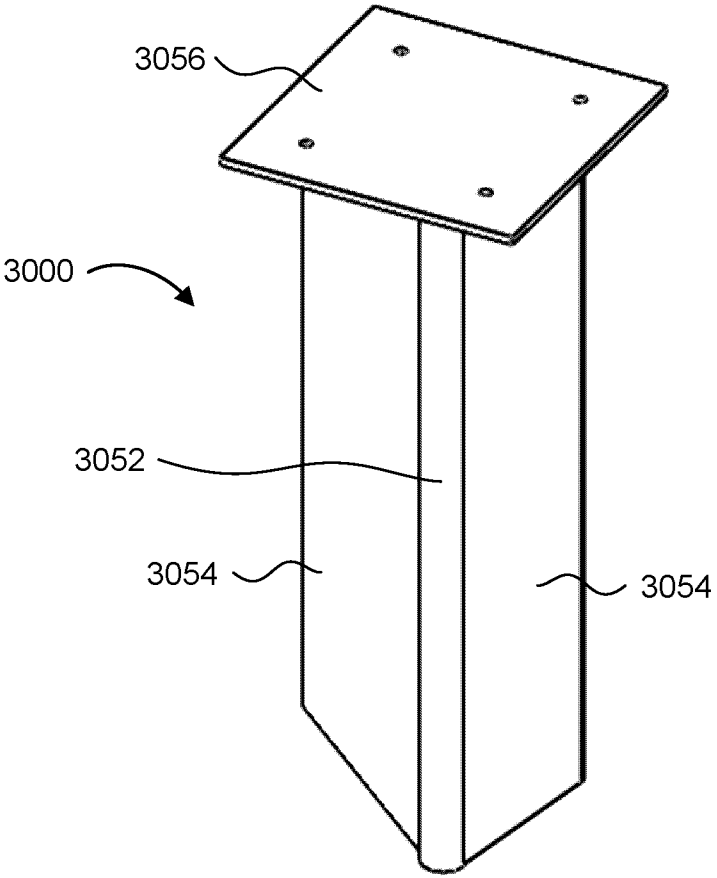
FIGS. 30A and 30B are perspective view of lateral support assemblies, in accordance with embodiments of the present application.
Figure 30A:
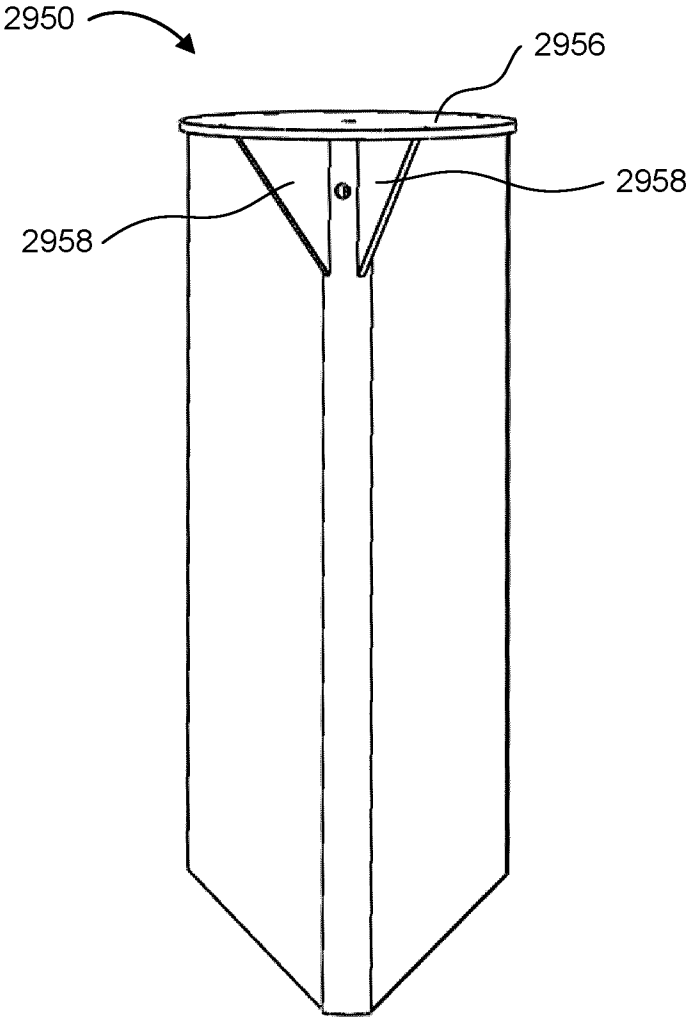

Reference is made to FIGS. 30A and 30B, which illustrate perspective views of lateral support assemblies, in accordance with embodiments of the present application.

FIG. 30A illustrates the lateral support assembly 2950 of FIGS. 29A and 29B. The lateral support assembly 2950 includes the weldment portion 2956 providing a circular or elliptical cross-sectional area for providing a support surface to an above-grade support post. In some embodiments, the lateral support assembly 2950 may include one or more gussets 2958 to support the weldment portion 2956. For example, when an above-grade post may be installed and/or coupled to the weldment portion 2956, the one or more gussets 2958 may provide additional support to the weldment portion 2956 for counteracting weight of the above-grade post (e.g., installed on the weldment portion 2956).

FIG. 30B illustrates a lateral support assembly 3000 having features similar to the lateral support assembly 2950 of FIG. 30A. The lateral support assembly 3000 may include one or more plate members 3054 affixed to an elongate member 3052. In some embodiments, the elongate member 3052 may be a hollow elongate member for receiving and coupling to a pile driven into a ground substrate.

The lateral support assembly 3000 may include a weldment portion 3056 affixed to the elongate member 3052 and/or the one or more plate members 3054. In FIG. 30B, the weldment portion 3056 is configured to provide a substantially rectilinear support surface (e.g., a rectangular or square cross-sectional area) for supporting an above-grade support post. In some embodiments, the weldment portion 3056 may include one or more apertures for receiving fasteners (e.g., bolts) for securing an above-grade support post to the lateral support assembly 3000.

Figure 31B:
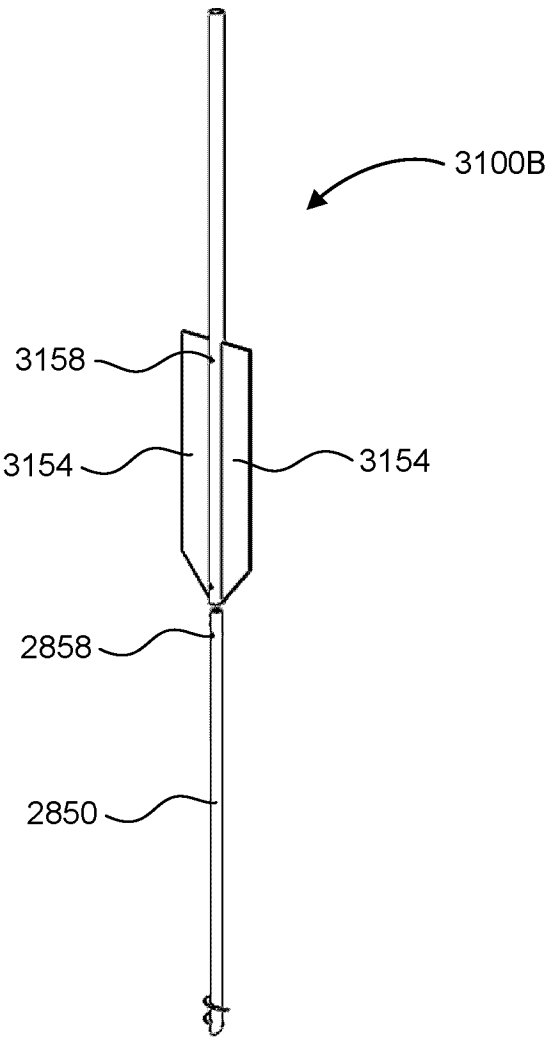
FIGS. 31A and 31B are perspective views of foundation post assemblies, in accordance with embodiments of the present application.
Figure 31A:
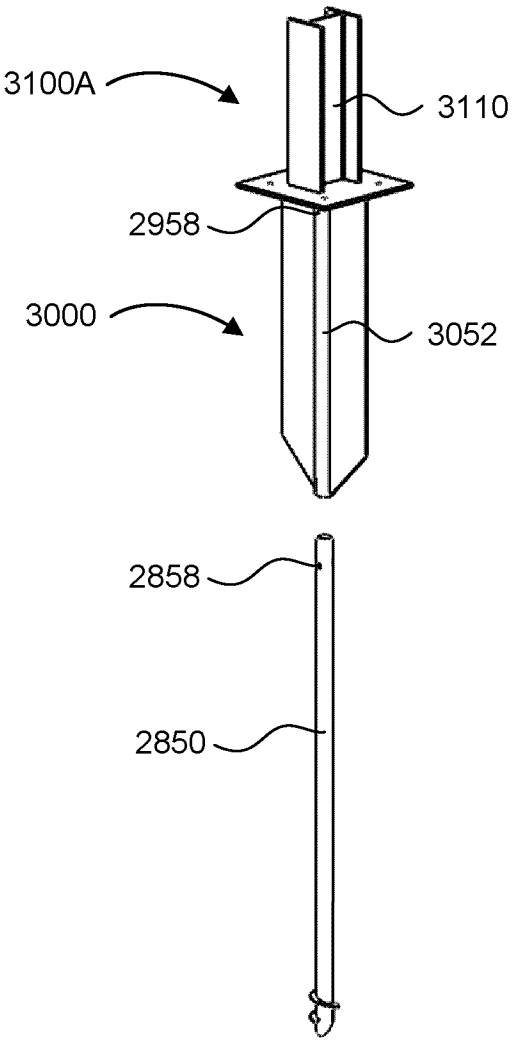

Reference is made to FIGS. 31A and 31B, which illustrate foundation post assemblies, in accordance with embodiments of the present application. In some embodiments, an above-grade support post may be coupled to a lateral support assembly, and the combination may be installed over a foundation post (e.g., hollow steel section, I-beam/H-beam, cylindrical pile, or the like) that has been driven or vibrated into the ground substrate.

FIG. 31A illustrates an above-grade support post 3100A coupled to the lateral support assembly 3000 of FIG. 30B, in accordance with an embodiment of the present application. The above-grade support post 3110 may be an I-beam or an H-beam and may be coupled to the lateral support assembly 3000 by welding, by fasteners, or by other coupling methods.

In some scenarios, the cylindrical pile 2850 may be rotationally driven into a ground substrate and, subsequently, the combination of the above-grade support post 3100A and the lateral support assembly 3000 may be translationally vibrated or driven into ground substrate, such that elongate member 3052 of the lateral support assembly 3000 may receive a portion of the above-grade support post 3100A. In some embodiments, when the support aperture 2958 of the lateral support assembly 3000 and the pile aperture 2858 are aligned, a pin or screw-nut combination may be placed within the aligned apertures to reduce movement of the lateral support assembly 3000 relative to the cylindrical pile 2850. As the combination of the above-grade support post 3100A and the lateral support assembly 3000 may be installed atop the cylindrical pile 2850, in some scenarios, the above-grade support post may be removed and replaced with another above-grade support post having a lateral support assembly coupled thereto. By modularizing a pile driven into a ground substrate and features for securing a support post to the below-grade foundation pile, above-grade support posts may be configured as temporary installations or may be replaced for remedying damage to above-grade support posts. In some embodiments, the elongate member 3052 of the lateral support assembly 3000 may be an engagement member for engaging the cylindrical pile 2850.

FIG. 31B illustrates another above-grade support post 3100B, in accordance with another embodiment of the present application. The above-grade support post 3100B may be a cylindrical pile or a pile having other geometric shape. The above-grade support post 3100B may include one or more plate members 3154 affixed to the cylindrical pile, where the one or more plate members 3154 may have a transverse direction greater than a post width of the cylindrical pile.

The above-grade support post 3100B may include a support aperture 3158. When the above-grade support post 3100B is vibrated or driven into the ground substrate, the above-grade support post 3100B may receive at least a portion of the below-grade cylindrical pile 2850. When a support aperture 3158 aligns with the pile aperture 2858, a pin or screw-nut combination may be inserted in the aligned apertures for securing the above-grade support post 3100B to the cylindrical pile 2850 and for reducing movement of the one or more plate members 3154 relative to the cylindrical pile 2850.

Figure 32:
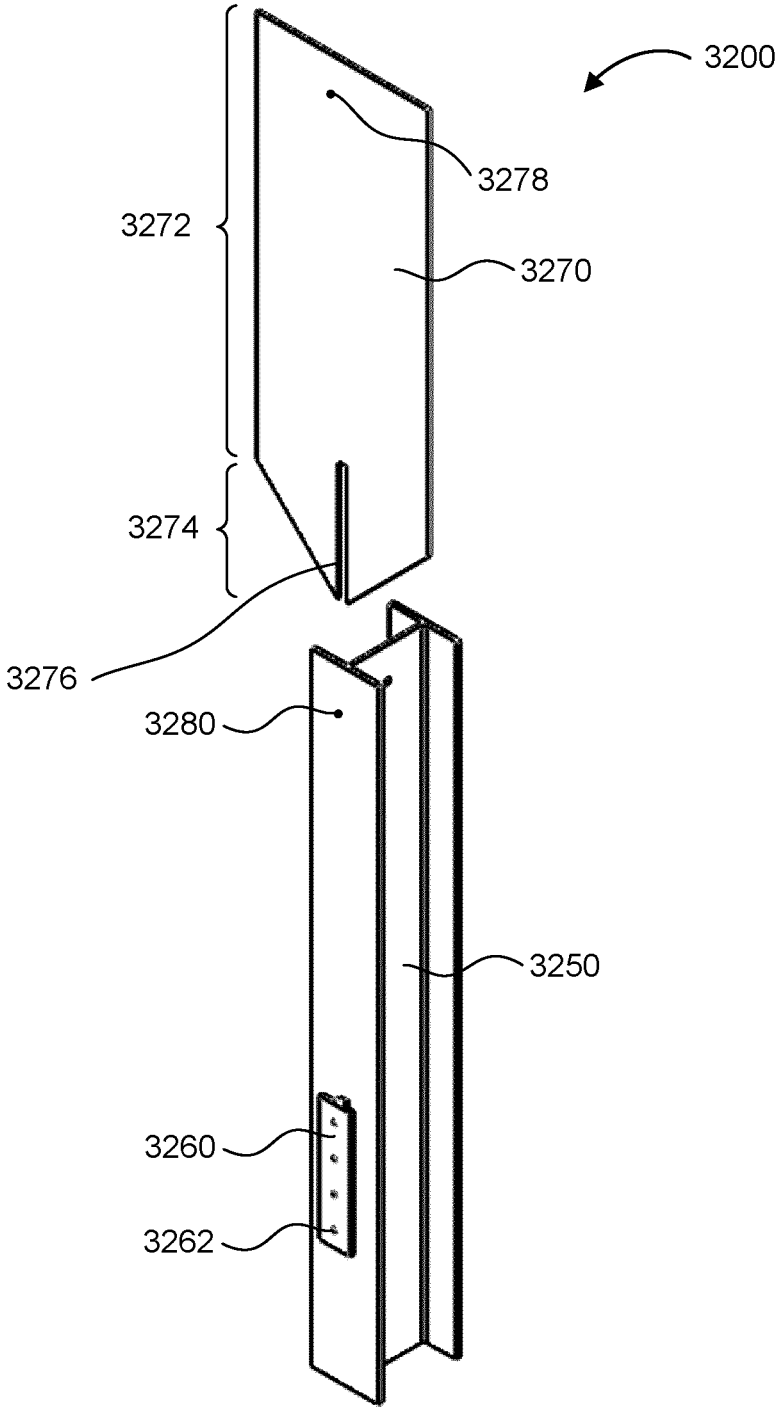
FIG. 32 is a perspective view of a lateral support assembly, in accordance with another embodiment of the present application.

Reference is made to FIG. 32, which illustrates a lateral support assembly 3200, in accordance with another embodiment of the present application. In the present example, at least one engagement member may include a support plate anchor 3260 affixed to the foundation pile 3250. Further, a support plate 3270 may include an elongate slot for slidable engagement with the support plate anchor 3260 below the grade, when the foundation pile 3250 is installed in the ground substrate.

In particular, the lateral support assembly 3200 may include a foundation pile 3250. In FIG. 32, the foundation pile 3250 is an H-beam/I-beam, however, the foundation pile 3250 may be other types of piles, such as hollow steel sections, cylindrical piles, etc.

The foundation pile 3250 may include a support plate anchor 3260. The support plate anchor 3260 may be affixed to the foundation pile 3250 using bolt fasteners. In some embodiments, the support plate anchor 3260 may be welded to the foundation pile 3250. Other coupling mechanisms for coupling the support plate anchor 3260 to the foundation pile 3250 may be contemplated.

The lateral support assembly 3200 may include a support plate 3270. The support plate 3270 may include a substantially rectilinear portion 3272 and a triangular-shaped portion 3274. A substantially pointed tip of the triangular-shaped portion 3274 may be configured to facilitate pushing of the support plate 3270 into the ground substrate.

The support plate 3270 may include an elongate slit 3276 configured to receive a portion of the support plate anchor 3260. Thus, upon the foundation pile 3250 being vibrated or driven into the ground substrate and upon the support plate 3270 being pushed into the ground substrate such that the elongate slit 3276 engages with a portion of the support plate anchor 3260, the support plate 3270: (a) may resist lateral forces imparted on the foundation pile 3250; and (b) may be secured to the foundation pile 3250, such that movement of the support plate 3270 relative to the foundation pile 3250 may be reduced.

In some embodiments, the support plate 3270 may include a plate fastening aperture 3278 for receiving a fastener for fastening the support plate 3270 to the foundation post 3250. That is, upon the support plate 3270 being slid to or engaging the support plate anchor 3260, the plate fastening aperture 3278 may receive a fastener for securing the support plate 3270 to the foundation post 3250. In some embodiments, the fastener may be received when the plate fastening aperture 3278 aligns with a post fastening aperture 3280. In some embodiments, the post fastening aperture 3280 may be positioned along the foundation post 3250 at a position corresponding to a desired position of the support plate 3270 relative to the foundation post 3250.

In scenarios where lateral plates may be fixed to a foundation pile (e.g., lateral plate not being removable form the foundation pile), design of a combination of the lateral support plate and the foundation pile may need to take into account forces that may be imparted on the lateral support plate when the combined unitary support plate/foundation pile is driven into the ground, such that the lateral support plate may not be separated or damaged. To reduce this additional design consideration, some embodiments of the present application may facilitate vibrating or driving a foundation post or pile into a ground substrate at a different time than embodiments of lateral support devices/assemblies described herein.

In some scenarios, torque measurements required to drive a pile or post into a ground substrate may be recorded as a proxy for calculating load bearing capacity of the installed pile or post for resisting uplift or lateral forces on the pile. In some examples, a rate of penetration of a driven pile into the ground substrate may be a proxy for determining density or load bearing capacity of the soil. However, when a lateral support plate may be fixed to the pile to provide a combined unitary support structure, torque measurements associated with driving a pile or post into the ground substrate may no longer be a suitable proxy or correlation to evaluate the ground substrate or projected performance of the pile. The lateral support plate of the unitary structure may compromise the correlation between torque required to install a pile and load bearing capacity of the installed pile. To ameliorate the deficiencies, embodiments of the present application may facilitate vibrating or driving a foundation post or pile into a ground substrate at a different time than lateral support devices/assemblies, such that torque measures may be a suitable proxy for evaluating projected performance of the foundation post or pile installed in the ground substrate.

In some embodiments, a series of foundation posts may be successively installed in a ground substrate. It may be desirable to provide a pile driver interconnection device for successively coupling a pile driver to foundation posts and for de-coupling the pile driver from foundation posts for efficient successive installation of foundation posts in the ground substrate. To illustrate embodiments of a pile driver interconnection device, reference is made to FIGS. 33 and 34.

Figure 33:
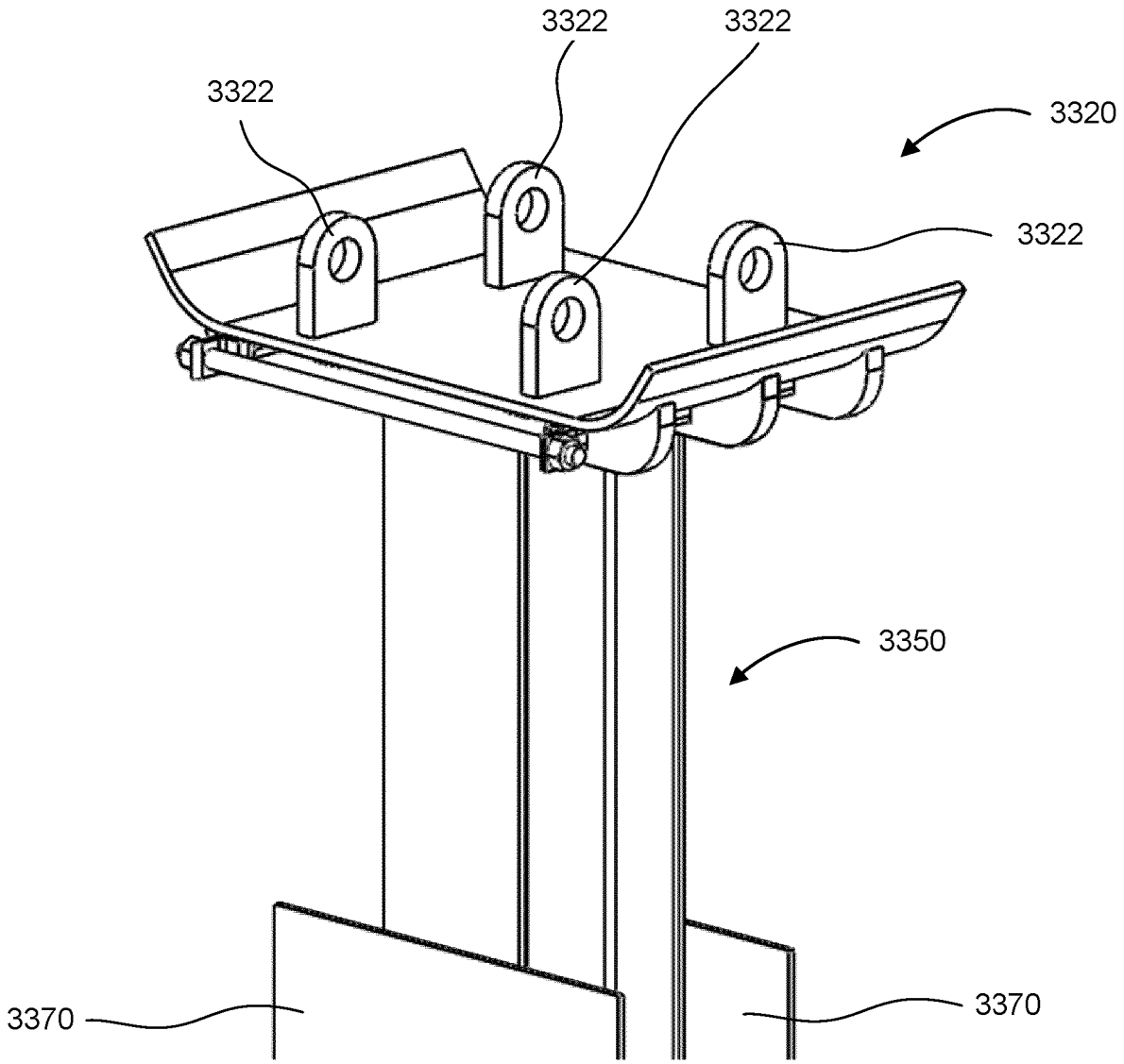
FIG. 33 is a perspective view of a pile driver interconnection device coupled to a foundation post, in accordance with an embodiment of the present application.

FIG. 33 illustrates a perspective view of a pile driver interconnection device 3320 coupled to a foundation post 3350, in accordance with an embodiment of the present application. The foundation post 3350 may be an H-beam/I-beam. In some other examples, the foundation post may be a rectilinear post or an elongate post having any other geometric shape. The foundation post 3350 may include one or more lateral support plates 3370 affixed to the foundation post 3350. The one or more lateral support plates 3370 may be affixed at one or more positions in an elongate direction of the foundation post 3350. The foundation post 3350 of FIG. 33 may include features similar to the foundation post 1900 illustrated in FIG. 19.

The pile driver interconnection device 3320 may include one or more coupling rings 3322 for engaging with a pile driver apparatus (not illustrated in FIG. 33). In some embodiments, the pile driver interconnection device 3320 may be geometrically shaped to interface with the pile driver apparatus. In the example illustrated in FIG. 33, the pile driver interconnection device 3320 may include opposing raised edges for mating with the pile driver apparatus. Other geometric configurations may be contemplated. The pile driver apparatus may be configured to vibrate and/or drive an elongate foundation post into the ground substrate.

Figure 34:
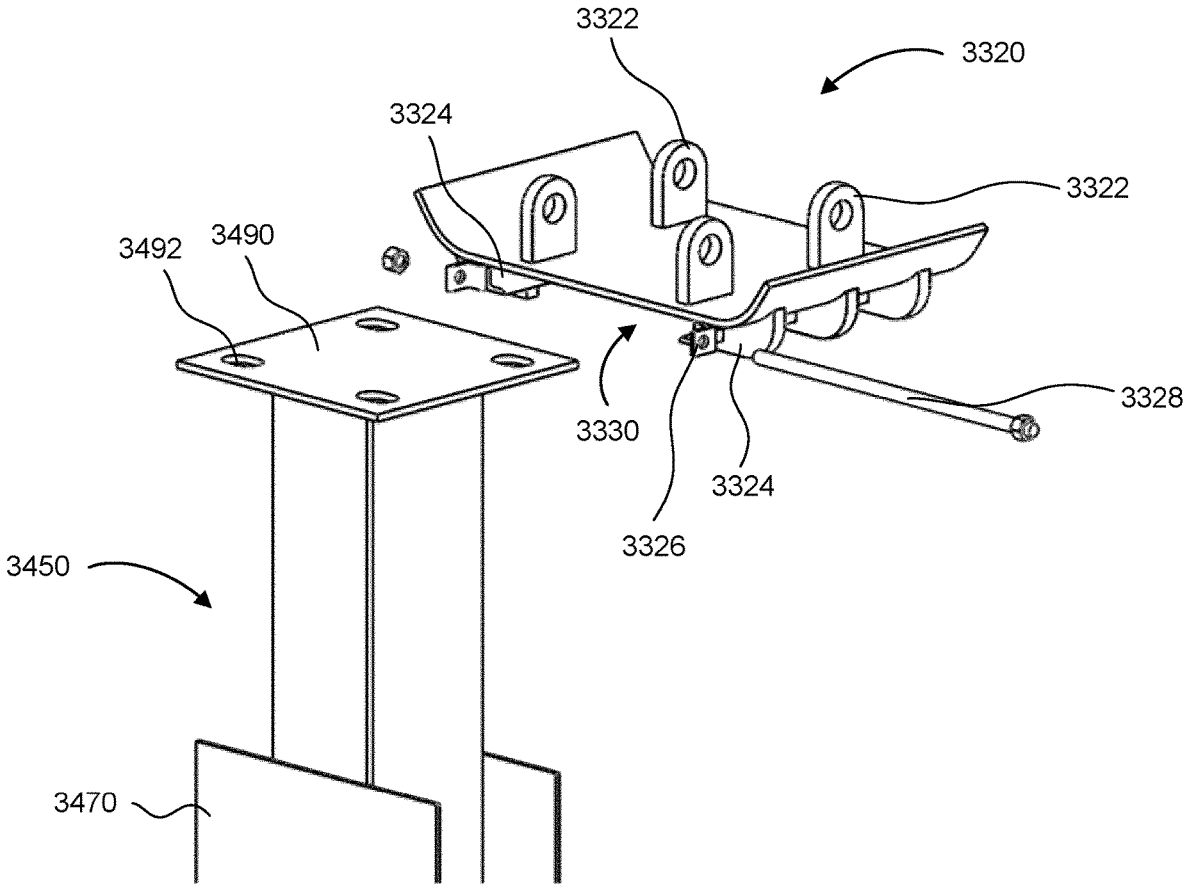
FIG. 34 is a partially exploded view of the pile driver interconnection device of FIG. 33 and a foundation post.

FIG. 34 illustrates a partially exploded view of the pile driver interconnection device 3320 of FIG. 33 and a foundation post 3450, in accordance with an embodiment of the present application. In FIG. 34, the foundation post 3450 may be a rectilinear post. Other geometric shapes of the foundation post may be contemplated. The foundation post 3450 may have one or more lateral support plates 3470 affixed thereto.

The foundation post 3450 may also include a base plate 3490 affixed at an end of the foundation post 3450. In FIG. 34, the base plate 3490 may have a rectilinear shape to support an upright support post above the ground substrate. The base plate 3490 may include one or more apertures 3492 for receiving fasteners. The one or more apertures 3492 may receive fasteners for fastening an upright support post to the base plate 3490. In some other embodiments, the base plate 3490 may have any other geometric shape for supporting an upright support post above the ground substrate. For example, the base plate may be a circular base plate, or any other geometric shape.

The pile driver interconnection device 3320 may include one or more pairs of opposing cantilevered arms 3324 defining a cavity 3330 for receiving the base plate 3490. In some embodiments, the pair of opposing cantilevered arms 3324 may positioned on the pile driver interconnection device 3320 such that the base plate 3490 may be translationally slid between the pair of opposing cantilevered arms 3324 and within the cavity 3330. In some embodiments, the base plate 3490 may be translationally slide into the cavity 3330 and the pile driver interconnection device 3320 may include a back-stop feature to: (1) retain the base plate 3490 within the cavity; and/or (2) prevent the base plate 3490 from sliding away from the pile driver interconnection device 3320 at an opposing end (e.g., the opposing end being opposite the entry portion of the cavity 3330).

The pile driver interconnection device 3320 may include one or more fastening apertures 3326 for receiving one or more fasteners 3328. In some examples, the fasteners 3328 may be a bolt-nut combination or a rod. The fasteners 3328 may be positioned on opposing sides of the pile driver interconnection device 3320 for retaining the base plate within the cavity 3330.

Figure 35:
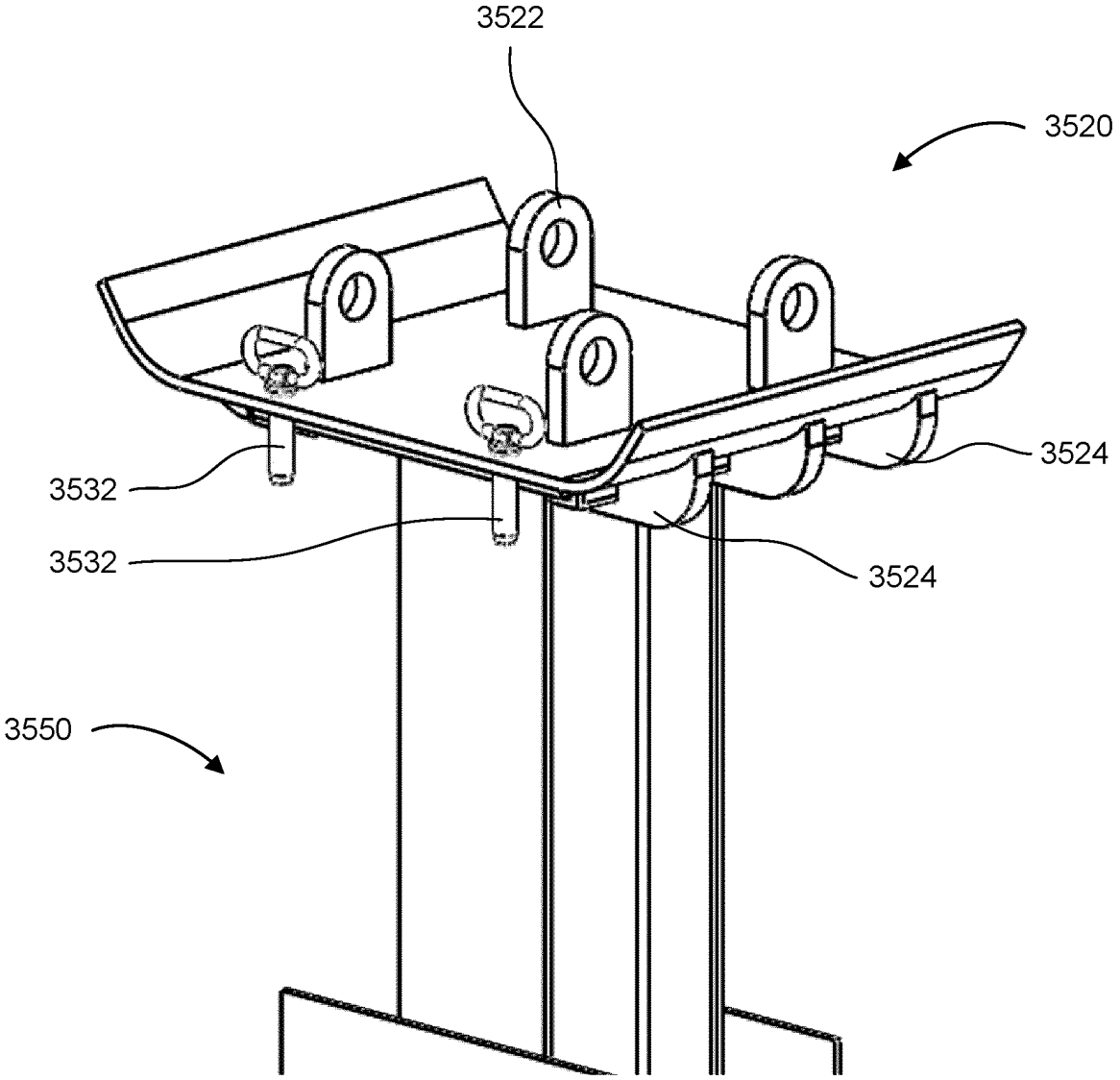
FIG. 35 is a perspective view of a pile driver interconnection device coupled to a foundation post, in accordance with another embodiment of the present application.
Figure 36:
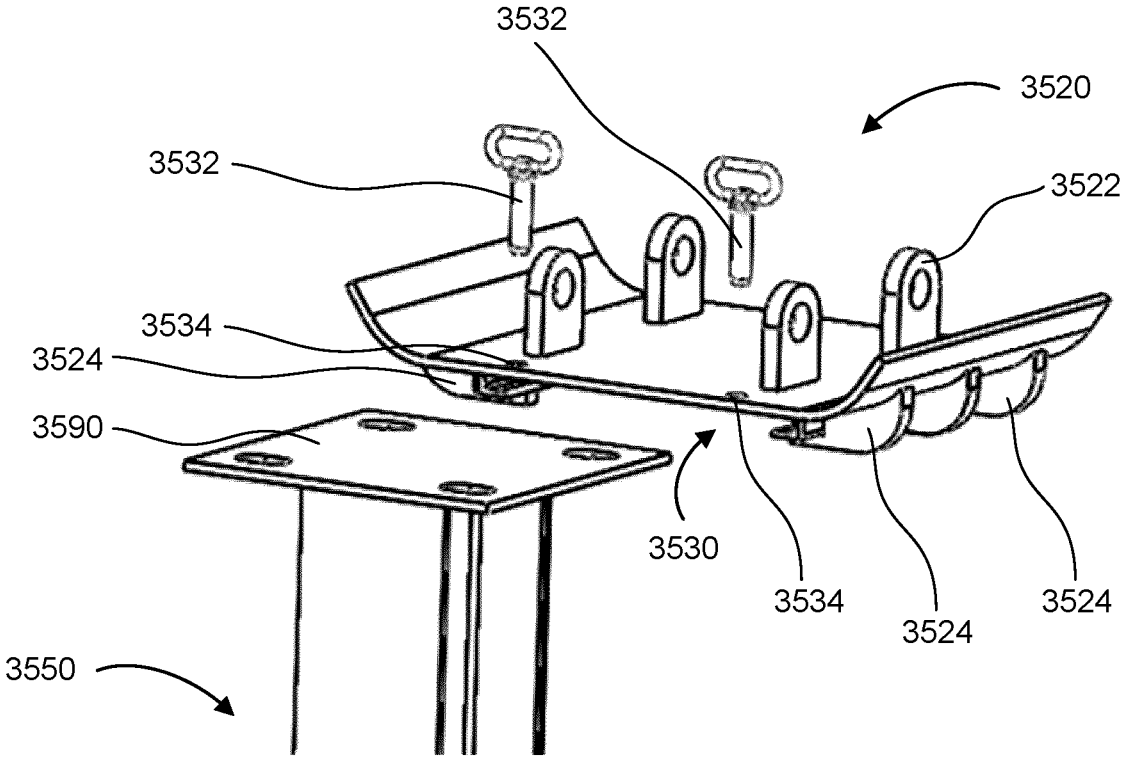
FIG. 36 is a partially exploded view of the pile driver interconnection device 3520 of FIG. 35 and the foundation post.

Reference is made to FIGS. 35 and 36, which illustrate another embodiment of a pile driver interconnection device 3520, in accordance with an embodiment of the present application.

FIG. 35 illustrates a perspective view of the pile driver interconnection device 3520 coupled to a foundation post 3550. The pile driver interconnection device 3520 may include one or more coupling rings 3522 for engaging with a pile driver apparatus (not illustrated in FIG. 35). The pile driver interconnection device 3520 may also include one or more pairs of opposing cantilevered arms 3524 collectively defining a cavity for receiving a base plate of the foundation post 3550. The one or more pairs of opposing cantilevered arms 3524 may be positioned such that the base plate may be translationally slid between the one or more pairs of opposing cantilevered arms 3524.

In FIG. 35, the pile driver interconnection device 3520 may include a plurality of apertures for receiving one or more retaining bolts 3532. When inserted into respective apertures, the retaining bolts 3532 may be configured to abut the base plate and retain the base plate between the one or more pairs of opposing cantilevered arms 3524.

FIG. 36 illustrates a partially exploded view of the pile driver interconnection device 3520 and the foundation post 3550. The pile driver interconnection device 3520 may be coupled to the foundation post 3550 by sliding the pile driver interconnection device 3520 such that the base plate 3590 of the foundation post is received within the cavity 3530 defined by the one or more pairs of opposing cantilevered arms 3524. When the base plate 3590 is received within the cavity 3530 defined by the one or more pairs of opposing cantilevered arms 3524, the retaining bolts 3532 may be inserted into interconnecting apertures 3534 to prevent the base plate 3590 from sliding out of the cavity 3530. The interconnecting apertures 3534 may be positioned on opposing sides of the pile driver interconnection device 3520.

Figure 37B:
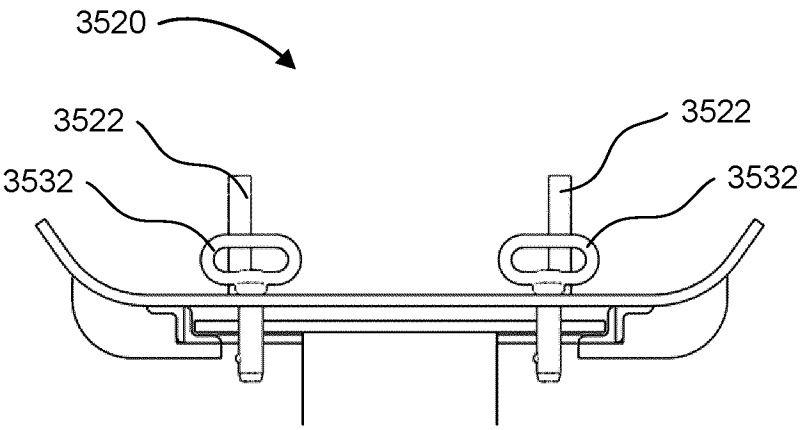
FIGS. 37A and 37B illustrate side elevation views of the pile driver interconnection device of FIG. 35 and a foundation post.
Figure 37A:
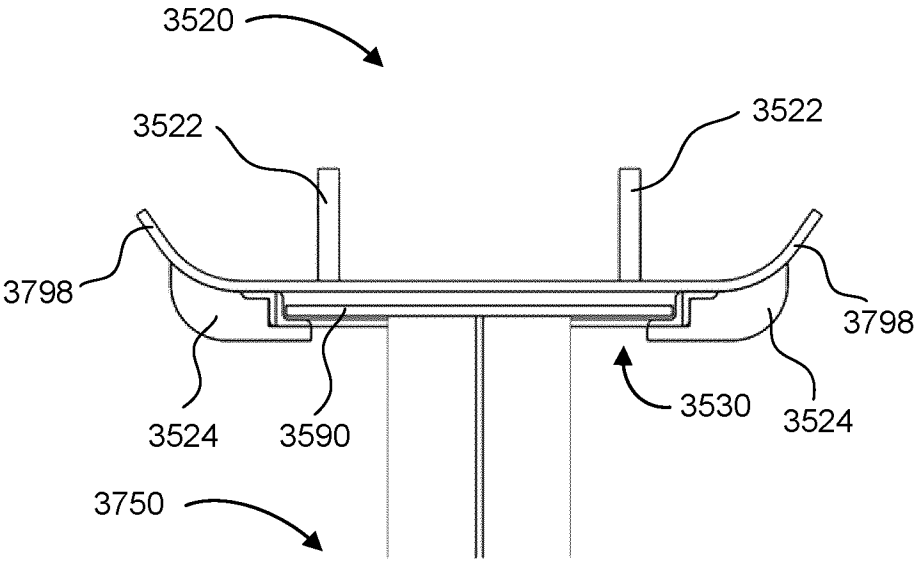

Reference is made to FIGS. 37A and 37B, which illustrate side elevation views of the pile driver interconnection device 3520 of FIG. 35 and a foundation post 3750. FIG. 37A illustrates the base plate 3590 received within the cavity 3530, where the cavity 3530 may be defined by the one or more pairs of opposing cantilevered arms 3524.

To maintain coupling of the pile driver interconnection device 3520 with the foundation post 3750, FIG. 37B illustrates one or more retaining bolts 3532 inserted into interconnecting apertures (apertures not explicitly illustrated in the side elevation view of FIG. 37B). The one or more retaining bolts 3532 may prevent the base plate from sliding out of the cavity 3530.

As illustrated in FIGS. 37A and 37B, the pile driver interconnection device 3520 may include opposing raised edges 3798 respectively associated with a cantilevered arm 3524. The opposed raised edges 3798 may be geometrically configured to mate with the pile driver apparatus.

Embodiments of the pile driver interconnection device may include features for translationally engaging a pile driver interconnection device to an elongate post. A pile driver may interconnect with the pile driver interconnection device to transfer translational motion or vibration to install the foundation post in the ground substrate. Retaining bolts or similar fasteners may be used for expediently retaining or releasing the base plate to the pile driver interconnection device. Accordingly, the pile driver interconnection device may be configured to successively couple and uncouple to a series of foundation posts that may be installed in the ground substrate.

In some embodiments, as the pile driver interconnection device may translationally engage and/or retain an elongate post as vibration is imparted to the elongate post, transfer of translational motion or vibration to install the elongate post into the ground substrate may be provided with greater accuracy and with greater control.

In some embodiments, a post is provided. The post may include an elongate beam member at least having a web and at least one flange extending along an edge of the web, the at least one flange being arranged generally at a right angle to the web and presenting a generally planar, outer surface; and at least one plate member affixed to the outer surface of the at least one flange, the at least one plate member lying in a plane generally parallel to the plane of the at least one flange, and extending beyond at least one side edge of the at least one flange, wherein the elongate beam member is to be driven into an earth formation with at least a portion of the at least one plate member extending below grade.

In some embodiments, the at least one plate member extends beyond opposite side edges of the at least one flange.

In some embodiments, the elongate beam member is to be driven into the earth formation with a substantial portion of the at least one plate member extending below grade.

In some embodiments, the elongate beam member is to be driven into the earth formation with a top edge of the at least one plate member positioned at or slightly below grade.

In some embodiments, the elongate beam member comprises: a web and a single flange extending along the edge of the web; or a web and a pair of generally parallel flanges extending along opposite edges of the web, the flanges being arranged generally at right angles to the web and presenting oppositely facing, generally planar outer surfaces, and the web and the flanges defining at least one channel.

In some embodiments, the elongate beam member comprises the web and the pair of generally parallel flanges, and wherein at least one plate member is affixed to the outer surface of each flange.

In some embodiments, the plate members affixed to the flanges are (i) generally at the same lengthwise positions along the elongate beam member or (ii) at longitudinally offset positions along the elongate beam member.

In some embodiments, a lower portion of the at least one plate member tapers inwardly.

In some embodiments, the post may include at least one uplift resist formation on the outer surface of the at least one flange. The post may include a plurality of uplift resist formations on the outer surface of the at least one flange at longitudinally spaced locations. The uplift resist formations may be barbs, tabs, holes, punch-outs, or a combination thereof.

In some embodiments, each uplift resist formation may be positioned between a lower end of the elongate beam member and the at least one plate member. In some embodiments, the post may include at least one support surface adjacent an upper end of the beam member configured to support an upright post member.

In some embodiments, a sound wall is provided. The sound wall may include a plurality of laterally spaced, generally vertical, support posts, each support post comprising a lower portion extending into an underlying earth formation and an upper portion extending upwardly from the earth formation; and a plurality of stacked, elongate panels extending between the upper portions of the support posts, wherein the upper portion of each of the support posts is configured to receive respective ends of the panels, and wherein the lower portion of each of the support posts carries at least one plate member configured to resist forces imparted on the sound wall that act to tip/tilt the sound wall.

In some embodiments, each support post is continuous and of unitary construction and comprises an elongate beam member at least having a web and at least one flange extending along an edge of the web, the at least one flange being arranged generally at a right angle to the web, and the at least one plate member being affixed to the at least one flange.

In some embodiments, opposite side edges of the at least one plate member may extend beyond opposite edges of the at least one flange.

In some embodiments, the elongate beam member may include: a web and a single flange extending along the edge of the web; or a web and a pair of generally parallel flanges extending along opposite edges of the web, the flanges being arranged generally at right angles to the web and presenting oppositely facing, generally planar outer surfaces, and the web and the flanges defining at least one channel.

In some embodiments, the elongate beam member may include the web and the pair of generally parallel flanges, and wherein at least one plate member is affixed to the outer surface of each flange. The plate members may be (i) generally at the same lengthwise position along the support post or (ii) at longitudinally offset positions along the support post.

In some embodiments, the lower portion of each support post further comprises a plurality of uplift resist formations thereon at longitudinally spaced locations. The uplift resist formations may be barbs, tabs, holes, punch-outs, or a combination thereof.

In some embodiments, each support post is multi-component, the lower portion of each support post comprising a foundation post carrying the at least one plate member and the upper portion comprising an upright post mounted on the foundation post that receives the ends of the panels. Each foundation post may include an elongate beam member at least having a web and at least one flange extending along an edge of the web, the at least one flange being arranged generally at a right angle to the web, and the at least one plate member being affixed to the at least one flange.

In some embodiments, opposite side edges of the at least one plate member may extend beyond opposite edges of the at least one flange.

In some embodiments, the elongate beam member may include: a web and a single flange extending along the edge of the web; or a web and a pair of generally parallel flanges extending along opposite edges of the web, the flanges being arranged generally at right angles to the web and presenting oppositely facing, generally planar outer surfaces, and the web and the flanges defining at least one channel. The elongate beam member may include the web and the pair of generally parallel flanges, and wherein at least one plate member is affixed to the outer surface of each flange. The plate members affixed to each support post may be (i) generally at the same lengthwise position along the support post or (ii) at longitudinally offset positions along the support post.

In some embodiments, the foundation post and the upright post may have the same configuration, or different configurations. In some embodiments, the sound wall includes a series of support posts. The stacked elongate panels may extend between each adjacent pair of support posts.

In some embodiments, a post is provided. The post may include an elongate member; and at least one plate member having oppositely facing major surfaces, wherein one of the major surfaces is affixed directly to the elongate member, wherein the at least one plate member is dimensioned to extend beyond a width of the elongate member, and wherein the elongate member is to be driven into an earth formation with at least a substantial portion of the at least one plate member extending below grade. In some embodiments, the elongate beam member may be driven into the earth formation with a top edge of the at least one plate member positioned at or slightly below grade.

Although the sound wall is described as comprising stacked, elongate panels formed of plastic material and carrying mating formations, those of skill in the art will appreciate that alternatives are available. For example, the elongate panels may be formed of other suitable material such as wood, particle board, wafer board, light weight concrete, steel, aluminum etc. The elongate panels may also be devoid of mating formations and simply have abutting surfaces.

Although embodiments have been shown and described, those of skill in the art will appreciate that other variations and modifications may be made without departing from the scope thereof as defined by the appended claims.

What is claimed is:

1. An elongate foundation post assembly for positioning in a substrate comprising:

an elongate foundation post having a lower post end; and a support plate including at least one engagement member for engaging the elongate foundation post, the support plate having a plate width greater than a width of the elongate foundation post, and wherein the support plate is slidable along a length of the elongate foundation post in an elongate direction to engage at any one of two or more positions along the length of the elongate foundation post when at least a portion of the support plate is positioned below grade of the substrate, and wherein the support plate includes a top edge and an opposing bottom edge, the bottom edge being a leading edge when the support plate is pushed into the substrate, and wherein the lower post end is slidable past the bottom edge of the support plate when the elongate foundation post slidably engages with the support plate from the top edge to the opposing bottom edge of the support plate.

2. The elongate foundation post assembly of claim 1, comprising a fastener for fastening at least one of the engagement member or the support plate to the elongate foundation post below the grade.

3. The elongate foundation post assembly of claim 1, wherein the at least one engagement member includes a hollow section defining a sleeve insertable over an end of the elongate foundation post.

4. The elongate foundation post assembly of claim 1, wherein the elongate foundation post is an H-beam having a flange, and wherein the at least one engagement member includes one or more cantilevered protrusions extending from the support plate for engaging the flange.

5. The elongate foundation post assembly of claim 1, wherein the at least one engagement member has an elongate dimension in the elongate direction less than the length of the elongate foundation post.

* * * * *